US009037006B2

(12) United States Patent
Takahashi

(10) Patent No.: US 9,037,006 B2
(45) Date of Patent: May 19, 2015

(54) IMAGE FORMING APPARATUS WITH A REGULATING MEMBER FOR REGULATING INSERTION OF UNITS INTO AN INTERNAL SPACE OF THE APPARATUS

(71) Applicant: KYOCERA Document Solutions Inc., Osaka-shi, Osaka (JP)

(72) Inventor: Satoru Takahashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 22 days.

(21) Appl. No.: 13/778,791

(22) Filed: Feb. 27, 2013

(65) Prior Publication Data

US 2013/0223854 A1 Aug. 29, 2013

(30) Foreign Application Priority Data

Feb. 29, 2012 (JP) ..... 2012-043412

(51) Int. Cl.
*G03G 21/16* (2006.01)
*G03G 15/00* (2006.01)
*G03G 21/18* (2006.01)

(52) U.S. Cl.
CPC ..... *G03G 21/1647* (2013.01); *G03G 15/55* (2013.01); *G03G 21/1623* (2013.01); *G03G 21/1896* (2013.01)

(58) Field of Classification Search
CPC ..... G03G 21/1821; G03G 21/1647; G03G 21/1623; G03G 21/1896; G03G 15/55
USPC ..... 399/113, 120, 360
See application file for complete search history.

(56) References Cited

U.S. PATENT DOCUMENTS

| | | | | |
|---|---|---|---|---|
| 5,311,253 | A | 5/1994 | Ohmori et al. | |
| 6,055,406 | A * | 4/2000 | Kawai et al. | 399/360 |
| 7,242,874 | B2 * | 7/2007 | Tsusaka | 399/13 |
| 7,831,190 | B2 * | 11/2010 | Yang | 399/360 |
| 2004/0109700 | A1 | 6/2004 | Lee | |
| 2005/0220461 | A1 | 10/2005 | Tsusaka | |
| 2010/0247140 | A1 * | 9/2010 | Kikuchi et al. | 399/111 |
| 2011/0142497 | A1 * | 6/2011 | Jeong | 399/123 |

FOREIGN PATENT DOCUMENTS

JP 2004-29132 1/2004

* cited by examiner

*Primary Examiner* — Clayton E Laballe
*Assistant Examiner* — Trevor J Bervik
(74) *Attorney, Agent, or Firm* — Gerald E. Hespos; Michael J. Porco; Matthew T. Hespos

(57) ABSTRACT

An image forming apparatus has an image forming section, a casing, a wall section, a first unit, a second unit and a first regulating member. The casing has an internal space in which the image forming section is disposed. The first unit is mounted in a first position of the internal space. The first insertion path is a path through which the first unit passes in the internal space. The second unit is mounted in a second position of the internal space closer to the wall section than the first position is. The second insertion path is a path through which the second unit passes in the internal space. The first regulating member projects to the second insertion path when the first unit is not mounted in the first position and retracts from the second insertion path when the first unit is mounted in the first position.

15 Claims, 25 Drawing Sheets

IMAGE FORMING APPARATUS WITH A REGULATING MEMBER FOR REGULATING INSERTION OF UNITS INTO AN INTERNAL SPACE OF THE APPARATUS

This application is based on Japanese Patent Application No. 2012-043412 filed in Japan Patent Office on Feb. 29, 2012, the contents of which are hereby incorporated by reference.

BACKGROUND

There has conventionally been known a technology of an image forming apparatus in which a plurality of units are mounted for executing image forming processes on sheets. In this technology, a process unit is disposed as a first unit and a drum unit with a photosensitive drum is disposed as a second unit. The drum unit is mounted beforehand in the process unit and then mounted in the image forming apparatus.

The technology described above has a special detector for detecting whether the process unit is mounted in an apparatus main body or not. Because the process unit is previously mounted with the drum unit and then mounted in the apparatus main body, the process unit and the drum unit cannot be mounted separately in the apparatus main body. This places a limitation to the procedures of an assembly work and a maintenance work. When, on the other hand, the drum unit and the process unit can be mounted separately in the apparatus main body, the number of detectors equivalent to the number of units is required in order to detect whether the units are mounted or not.

The present disclosure was contrived in view of the problems described above, and an object thereof is to provide an image forming apparatus in which a plurality of units are mounted, wherein the number of detectors for detecting whether units to be mounted separately in the apparatus are mounted or not is reduced as much as possible.

SUMMARY

An image forming apparatus according to one aspect of the present disclosure has an image forming section, a casing, a wall section, a first unit, a first insertion path, a second unit, a second insertion path, and a first regulating member. The image forming section executes an image forming operation. The casing has a plurality of surfaces and an internal space in which the image forming section is disposed. The wall section is openable/closeable with respect to the casing, configures one surface of the casing in a closed state of the wall section, and opens the internal space to the outside of the casing in an open state of the wall section. The first unit is mounted in a first position of the internal space when the wall section enters the open state. The first insertion path is a path through which the first unit passes in the internal space when the first unit is mounted in the first position. The second unit is mounted in a second position of the internal space closer to the wall section than the first position is, when the wall section enters the open state. The second insertion path is a path through which the second unit passes in the internal space when the second unit is mounted in the second position. The first regulating member is capable of changing a state thereof between a first state in which the first regulating member projects to the second insertion path and interferes with the second unit when the first unit is not mounted in the first position, and a second state in which the first regulating member retracts from the second insertion path when the first unit is mounted in the first position.

DETAILED DESCRIPTION

Figure 1:
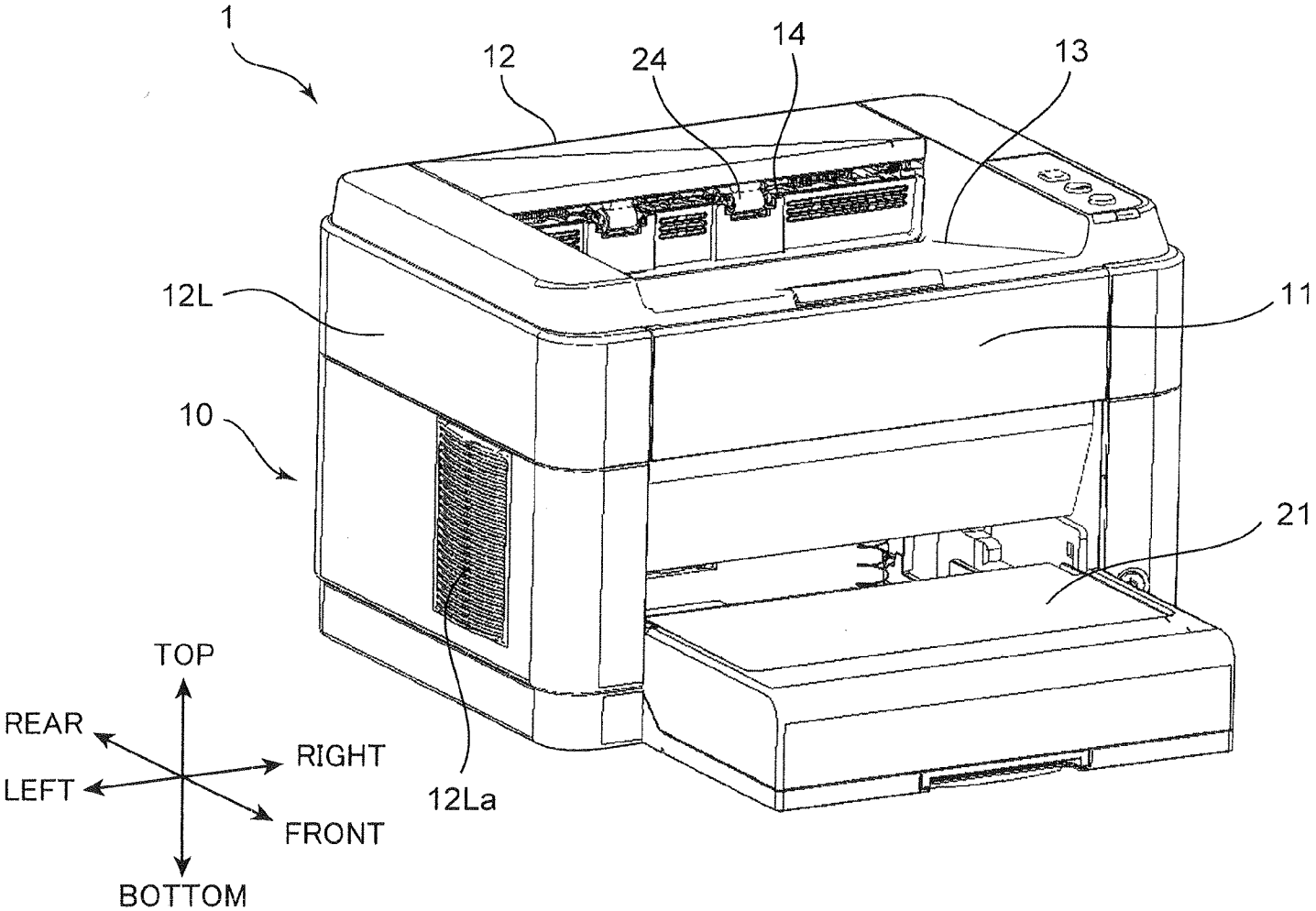
FIG. 1 is a perspective view showing an exterior of an image forming apparatus according to an embodiment of the present disclosure.
Figure 2:
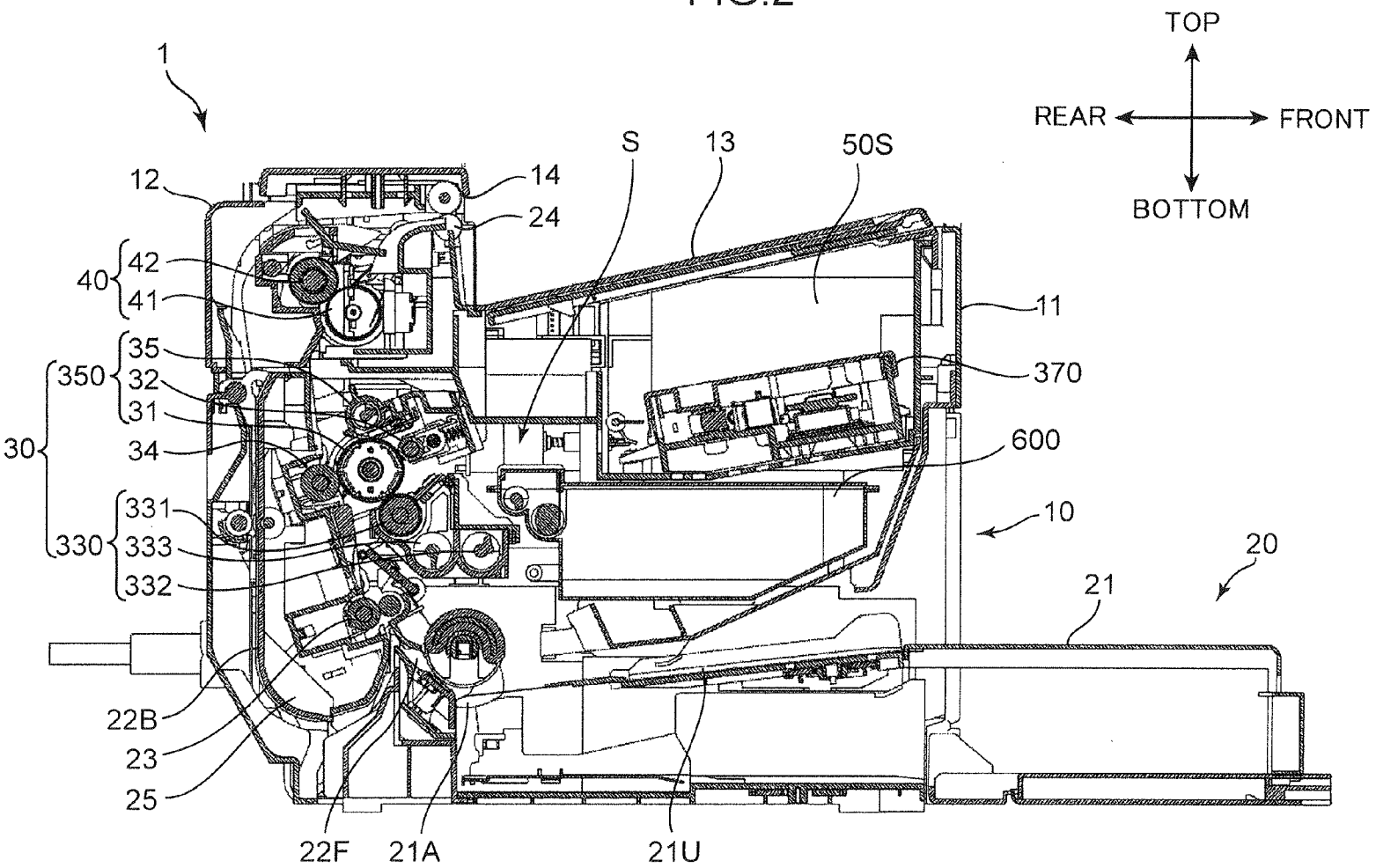
FIG. 2 is a side sectional diagram showing an internal structure of the image forming apparatus according to the embodiment of the present disclosure.

An embodiment of the present disclosure is described hereinafter in detail with reference to the drawings. FIG. 1 is a perspective view showing an exterior of an image forming apparatus 1 according to an embodiment of the present disclosure. FIG. 2 is a side sectional diagram showing an internal structure of the image forming apparatus 1 according to the embodiment of the present disclosure. A black and white printer is illustrated as the image forming apparatus 1; however, the image forming apparatus may be a copier, a facsimile machine, or a multifunction machine that combines the functions of a copier and a facsimile machine. Furthermore, an image forming apparatus that forms color images may be adopted.

The image forming apparatus 1 includes a main body housing 10 (casing) which has a chassis structure with an approximately rectangular parallelepiped shape, a paper feeding section 20, an image forming section 30, and a fixing section 40 housed inside the main body housing 10.

The main body housing 10 has a plurality of surfaces as external walls. The front-surface side and the rear-surface side of the main body housing 10 have a front cover 11 and a rear cover 12 (wall section), respectively. Opening the front cover 11 exposes a toner container storage section 50S, as shown in FIG. 2. A toner container, not shown, is disposed in the toner container storage section 50S. When toner runs out, a user can take out the toner container from the front-surface side of the main body housing 10. The rear cover 12 is a cover that is opened in the event of a sheet jam or upon maintenance. By opening the rear cover 12, the units such as the image forming section 30 and the fixing section 40 can respectively be taken out from the rear-surface side of the main body housing 10. In addition, a left cover 12L (FIG. 1) and a right cover 12R (a side wall, not shown in FIG. 1) on an opposite side to the left cover 12L are respectively provided on side surfaces of the main body housing 10 so as to extend in a perpendicular direction. An air inlet 12La for carrying air into the image forming apparatus 1 is provided on a front-side portion of the left cover 12L. Furthermore, a paper ejecting section 13 from which a sheet on which image formation is performed is ejected is provided on an upper surface of the main body housing 10. Various devices for executing image formation are mounted inside an internal space S (FIG. 2) that is defined by the front cover 11, the rear cover 12, the left cover 12L, the right cover 12R, and the paper ejecting section 13.

The paper feeding section 20 includes a paper cassette that houses sheets on which an image forming process is performed. A part of the paper cassette 21 protrudes further forward from the front surface of the main body housing 10. In the paper cassette 21, an upper surface of a portion housed inside the main body housing 10 is covered by a paper cassette top panel 21U. The paper cassette 21 has a sheet housing space that houses a stack of the sheets described above, a lift plate, not shown, which lifts the sheet stack when feeding paper, and the like. A sheet feeding section 21A is provided in an upper portion on a rear-end side of the paper cassette 21. A pickup roller (not shown) for feeding one sheet at a time from the top of the sheet stack in the paper cassette 21 is disposed in the sheet feeding section 21A.

The image forming section 30 performs an image forming process for forming a toner image on a sheet that is sent out from the paper feeding section 20. The image forming section 30 has a drum unit 350, a developing unit 330, a transfer roller 34, an exposure device 370, and a waste toner bottle 600.

The drum unit 350 with a chassis structure includes a photosensitive drum 31 (an image carrier), and a charging device (a charger) and a cleaning device 35 that are disposed around the photosensitive drum 31.

The photosensitive drum 31 rotates around a shaft thereof, and thereby an electrostatic latent image and a toner image are formed on a circumferential surface of the photosensitive drum 31. A photosensitive drum made of an amorphous silicon (a-Si) based material can be used as the photosensitive drum 31. The charging device 32 uniformly charges a surface of the photosensitive drum 31 and includes a charging roller that comes into abutment with the photosensitive drum 31. A charging bias is applied to the charging roller by a bias applying section 502 described hereinafter. The cleaning device includes a cleaning blade and the like, and cleans toner adhering to the circumferential surface of the photosensitive drum 31 after transfer of a toner image and conveys the toner to the waste toner bottle 600 described hereinafter.

The exposure device 370 has a laser light source and an optical system machine such as a mirror or a lens. The exposure device 370 irradiates the circumferential surface of the photosensitive drum 31 with light modulated based on image data supplied from an external device such as a personal computer, in order to form an electrostatic latent image on the circumferential surface of the photosensitive drum 31.

The developing unit 330 supplies toner to the circumferential surface of the photosensitive drum 31 in order to develop the electrostatic latent image formed on the photosensitive drum 31 to form a toner image. The developing unit 330 with a chassis structure includes a developing roller 331 that carries the toner to be supplied to the photosensitive drum 31, and first and second conveying screw 332 and 333 that circulate and convey a developer while agitating the developer inside the developing unit 330. A developing bias is applied to the developing roller 331 by a developing bias applying section, which is not shown. Note that in the present embodiment the toner is used as colorant for forming images on the sheets, but liquid toner, ink or the like may be used as the colorant.

The transfer roller 34 is a roller for transferring the toner image formed on the circumferential surface of the photosensitive drum 31 onto a sheet, and forms a transfer nip section together with the photosensitive drum 31. A transfer bias of a reverse polarity to the toner is applied to the transfer roller 34.

The fixing section 40 performs a fixing process for fixing the transferred toner image onto the sheet. The fixing section 40 includes a fixing roller 41 provided with an internal heat source and a pressure roller 42 that is pressed against the fixing roller 41 and forms a fixing nip section together with the fixing roller 41. When the sheet onto which the toner image is transferred is sent to the fixing nip section, the toner image is fixed onto the sheet by heat applied by the fixing roller 41 and pressure applied by the pressure roller 42. The fixing section 40 is housed in a box-shaped fixing housing, which is not shown.

The waste toner bottle 600 (waste colorant bottle) is in a flat rectangular parallelepiped shape and has an internal space for housing waste toner (waste colorant). Waste toner that is removed from the photosensitive drum 31 by the cleaning device 35 is conveyed to the waste toner bottle 600.

A main conveying path 22F and a reverse conveying path 22B are provided inside the main body housing 10 for conveying the sheets. The main conveying path 22F extends from the sheet feeding section 21A of the paper feeding section 20 to a paper outlet 14 provided so as to oppose the paper ejecting section 13 on the upper surface of the main body housing 10, via the image forming section 30 and the fixing section 40. The reverse conveying path 22B is a conveying path that is used when performing duplex printing on a sheet in order to return a sheet printed on one side to an upstream part in the image forming section 30 along the main conveying path 22F.

A resist roller pair 23 is disposed on the upstream side of the transfer nip section constituted by the photosensitive drum 31 and the transfer roller 34 along the main conveying path 22F. A sheet is stopped by the resist roller pair 23, subjected to skew correction, and then sent out to the transfer nip section at a predetermined image transfer timing. A plurality of conveying rollers for conveying the sheets are disposed at appropriate locations along the main conveying path 22F and the reverse conveying path 22B. For example, a discharge roller pair 24 is disposed in the vicinity of the paper outlet 14.

The reverse conveying path 22B is formed between an outer side surface of a reversing unit 25 and an inner surface of the rear cover 12 of the main body housing 10. Note that the transfer roller 34 and one of the rollers of the resist roller pair 23 are placed on an inner side surface of the reversing unit 25. The rear cover 12 and the reversing unit 25 are respectively rotatable around an axis of a fulcrum section 121 (FIG. 4) provided at a lower end constituted by the rear cover 12 and the reversing unit 25. The rear cover 12 is opened when a sheet jam occurs along the reverse conveying path 22B. The reversing unit 25 is opened in addition to the rear cover 12, when a sheet jam occurs along the main conveying path 22F or when removing the drum unit 350 or the developing unit 330 to the outside.

Figure 3:
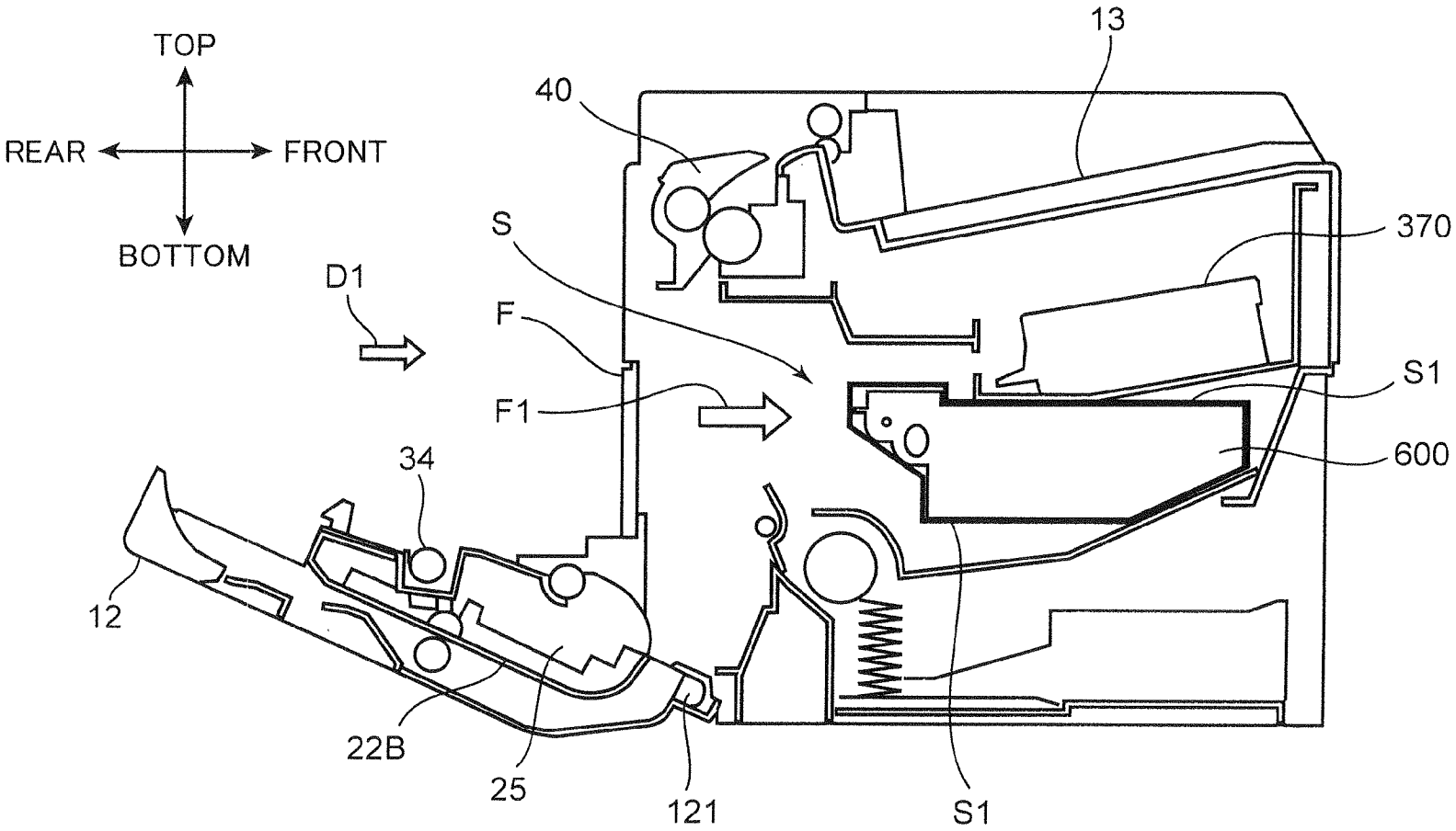
FIG. 3 is a schematic side sectional diagram showing a state in which a waste toner bottle is mounted in the image forming apparatus according to the embodiment of the present disclosure.
Figure 4:
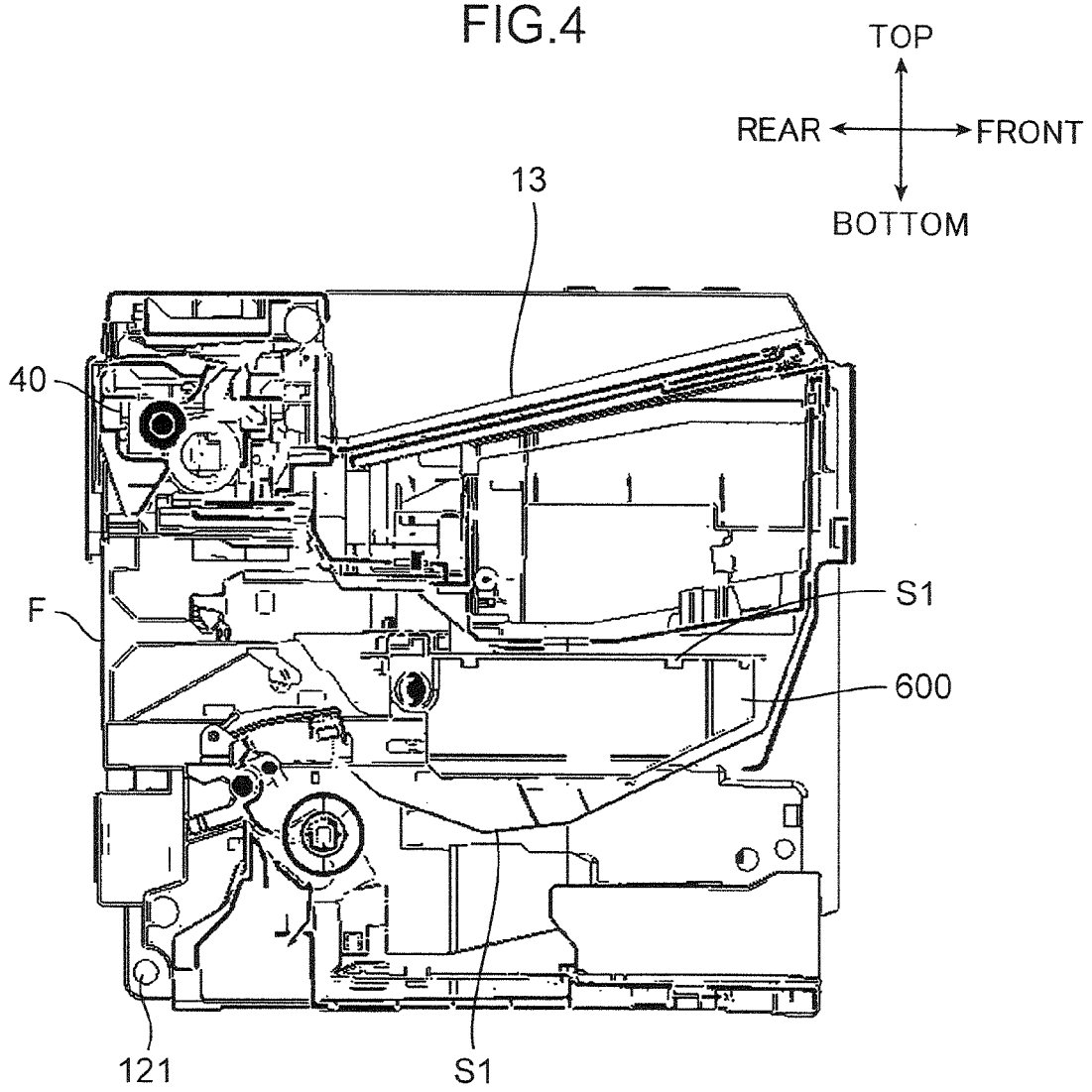
FIG. 4 is a side sectional diagram showing a state in which the waste toner bottle is mounted in the image forming apparatus according to the embodiment of the present disclosure.
Figure 5:
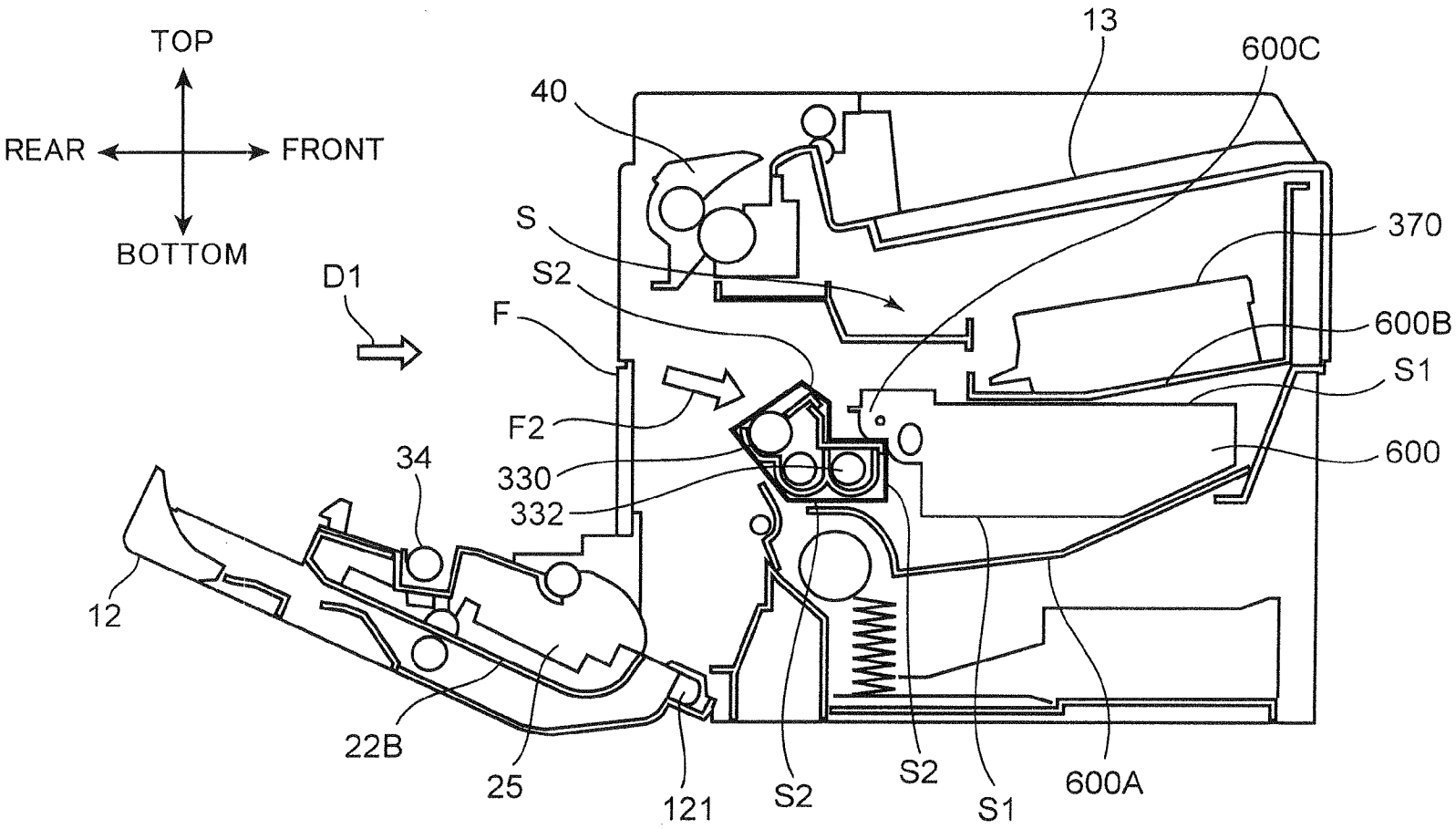
FIG. 5 is a schematic side sectional diagram showing a state in which the waste toner bottle and a developing device are mounted in the image forming apparatus according to the embodiment of the present disclosure.
Figure 6:
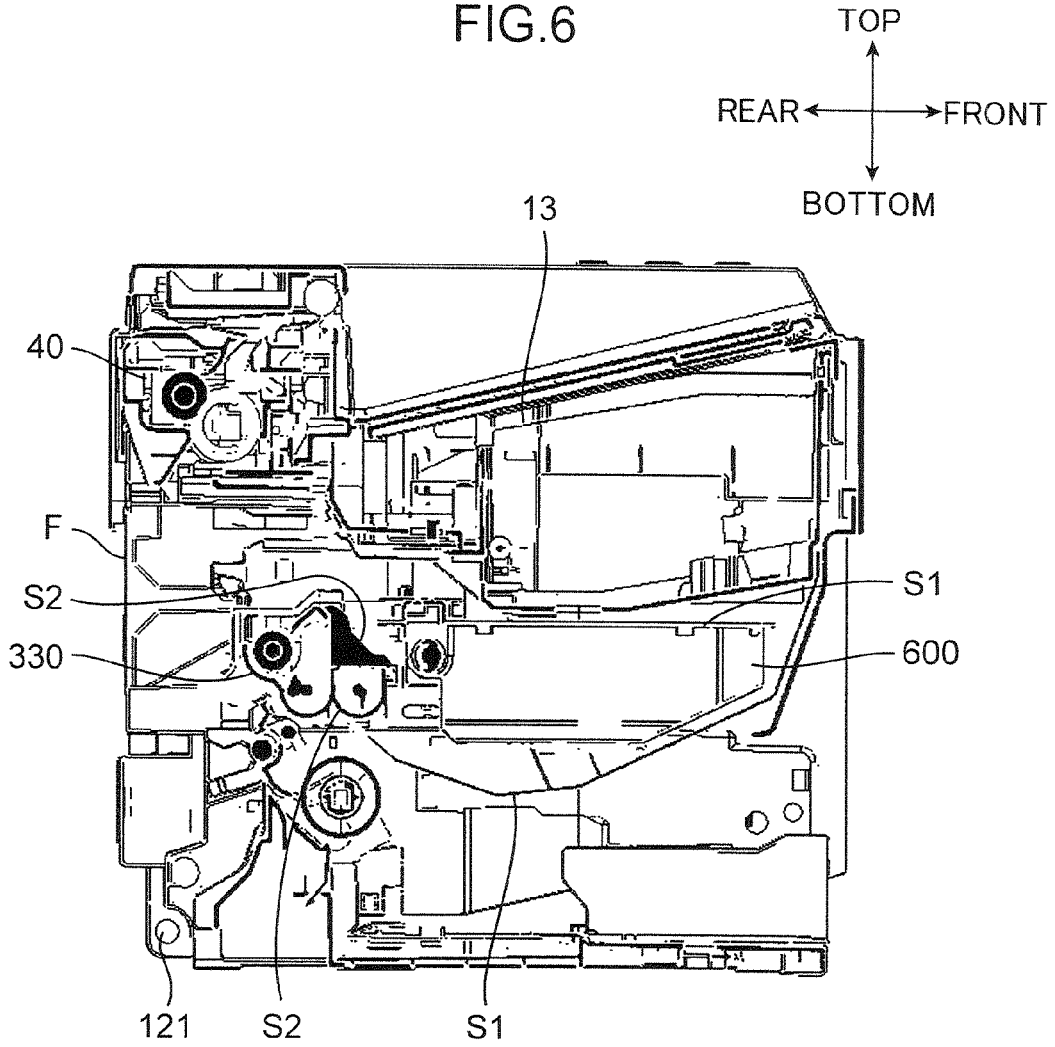
FIG. 6 is a side sectional diagram showing a state in which the waste toner bottle and the developing device are mounted in the image forming apparatus according to the embodiment of the present disclosure.
Figure 7:
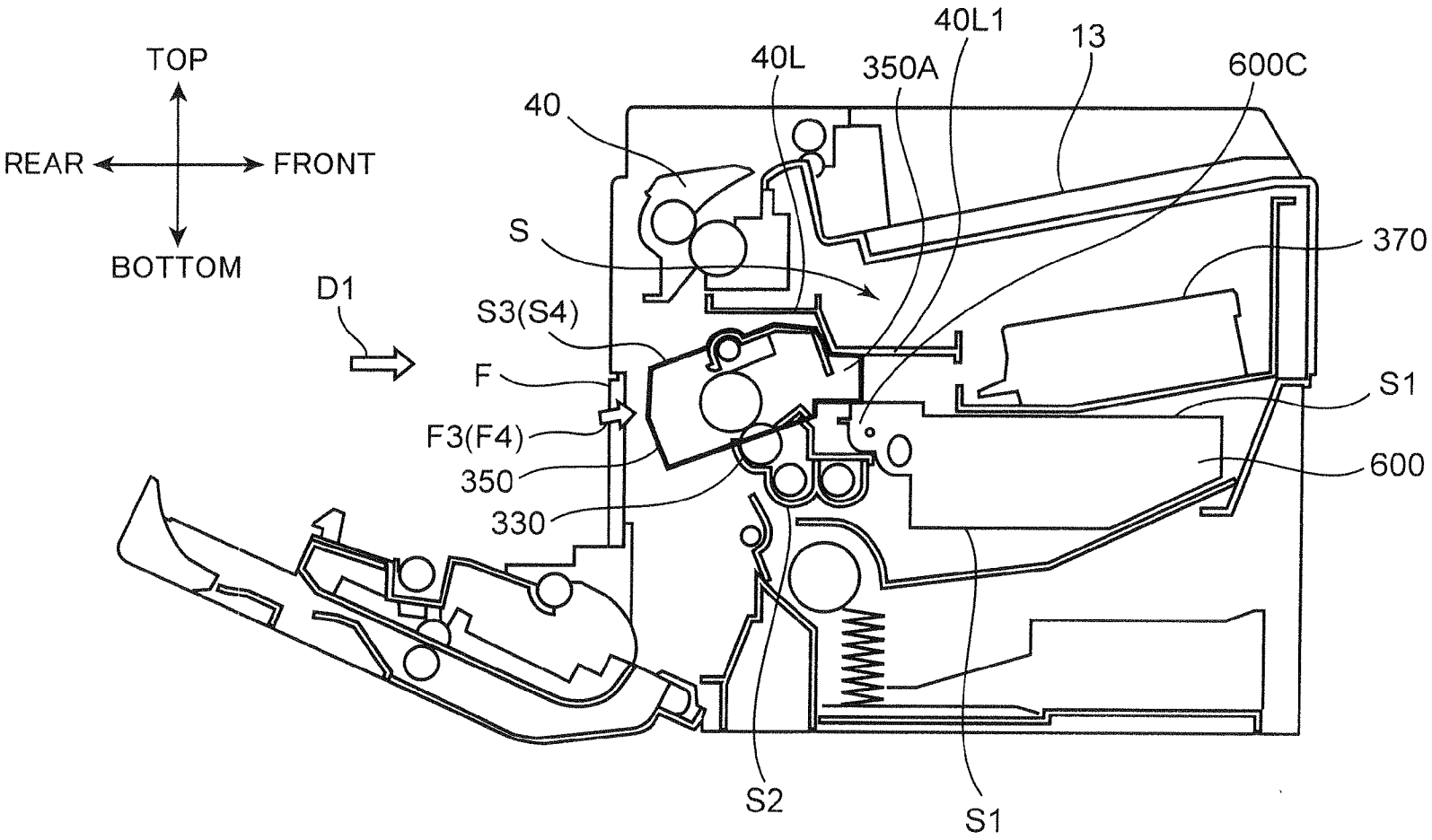
FIG. 7 is a schematic side sectional diagram showing a state in which the waste toner bottle, the developing device, and a drum unit are mounted in the image forming apparatus according to the embodiment of the present disclosure.
Figure 8:
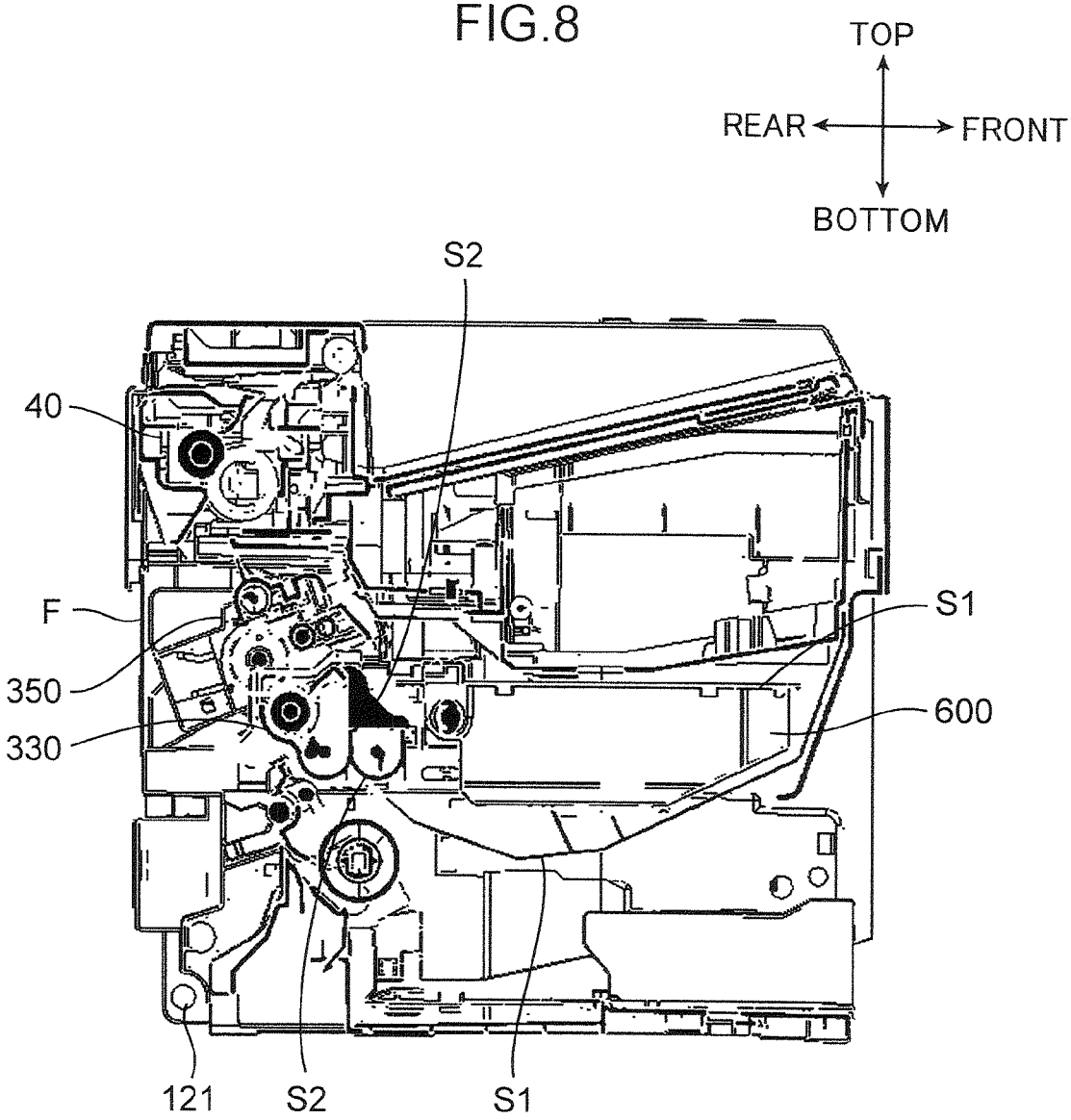
FIG. 8 is a side sectional diagram showing a state in which the waste toner bottle, the developing device, and the drum unit are mounted in the image forming apparatus according to the embodiment of the present disclosure.

Next, the arrangement of the units according to the embodiment of the present disclosure is described with reference to FIGS. 3 to 8. FIGS. 3 and 4 are side sectional diagrams each showing a state in which the waste toner bottle 600 is mounted in the main body housing 10 of the image forming apparatus 1. FIGS. 5 and 6 are side sectional diagrams each showing a state in which the waste toner bottle 600 and the developing unit 330 are mounted in the main body housing 10. FIGS. 7 and 8 are side sectional diagrams each showing a state in which the waste toner bottle 600, the developing unit 330, and the drum unit 350 are mounted in the main body housing 10. Note that none of FIGS. 4, 6 and 8 show the rear cover 12 and its peripheral members. Further, FIGS. 3, 5 and show first, second and third insertion paths, which are described hereinafter, with arrows F1, F2 and F3, respectively, but the first, second and third insertion paths actually correspond to spaces in the internal space S through which the units pass.

With reference to FIGS. 3 and 4, the rear cover 12, openable/closable with respect to the main body housing 10, configures one surface of the main body housing 10 in a closed state and opens the internal space S to the outside of the main body housing 10 in an open state. Opening the rear cover 12 exposes an insertion opening portion F to the inside of the main body housing 10 for mounting each of the units thereon. In so doing, the transfer roller 34, the reverse conveying path 22B, and the reversing unit 25 are moved together with the rear cover 12.

In the open state of the rear cover 12, the waste toner bottle 600 is mounted in a first position S1 of the internal space S. In so doing, the waste toner bottle 600 is mounted in the first position S1 as passing through the first insertion path F1 (the first insertion path) of the internal space S that extends from the insertion opening portion F to the first position S1, in a direction intersecting with the rear cover 12 (arrow D1). The first position S1 is located below the exposure device 370 in the internal space S of the main body housing 10.

With reference to FIGS. 5 and 6, the developing unit 330 is mounted in a second position S2 of the internal space S by opening the rear cover 12. In this case, the developing unit 330 is mounted in the second position S2 as passing through the second insertion path F2 (the second insertion path) of the internal space S that extends from the insertion opening portion F to the second position S2, in the direction intersecting with the rear cover 12 (arrow D1). The second position S2 is located closer to the rear cover 12 of the internal space S than the first position S1 is.

In the present embodiment, as shown in FIG. 5, a first frame 600A is provided below the waste toner bottle 600 so as to follow the outer shape of the waste toner bottle 600, and a second frame 600B is provided above the waste toner bottle 600. The second frame 600B is disposed between the exposure device 370 and the waste toner bottle 600. The developing unit 330 disposed in the second position S2 is disposed between the first frame 600A and the second frame 600B vertically so as to close the rear of the waste toner bottle 600. Therefore, in a state in which the developing unit 330 is mounted in the second position S2, an operator cannot access the waste toner bottle 600. Moreover, in the present embodiment, the part of the developing unit 330 that covers the first conveying screw 332 is disposed so as to enter a space below a rear end section 600C of the waste toner bottle 600 as shown in FIG. 5, in order to reduce the width in the front-back direction of the main body housing 10 as much as possible. The width in the front-back direction of the main body housing 10 can be reduced in such arrangement where the adjacent units partially overlap with each other vertically.

Further, with reference to FIGS. 7 and 8, the drum unit 350 is mounted in a third position S3 of the internal space S by opening the rear cover 12. In so doing, the drum unit 350 is mounted in the third position S3 as passing through the third insertion path F3 (the third insertion path) of the internal space S that extends from the insertion opening portion F to the third position S3, in the direction intersecting with the rear cover 12 (arrow D1). The third position S3 is located closer to the rear cover 12 of the internal space S than the first position S1 and the second position S2 are. The third position S3 is located at a level higher than the second position S2 in the internal space S. A third frame 40L is disposed above the drum unit 350. The fixing section 40 and the drum unit 350 are partitioned by the third frame 40L. Furthermore, a front end section 350A of the drum unit 350 is disposed so as to enter between the third frame 40L and the rear end section 600C of the waste toner bottle 600.

The drum unit 350 disposed in the third position S3 covers rear and upper sections of the developing unit 330 disposed in the second position S2. Therefore, in a state in which the drum unit 350 is mounted in the third position S3, the operator cannot access the developing unit 330 or the waste toner bottle 600.

Figure 9:
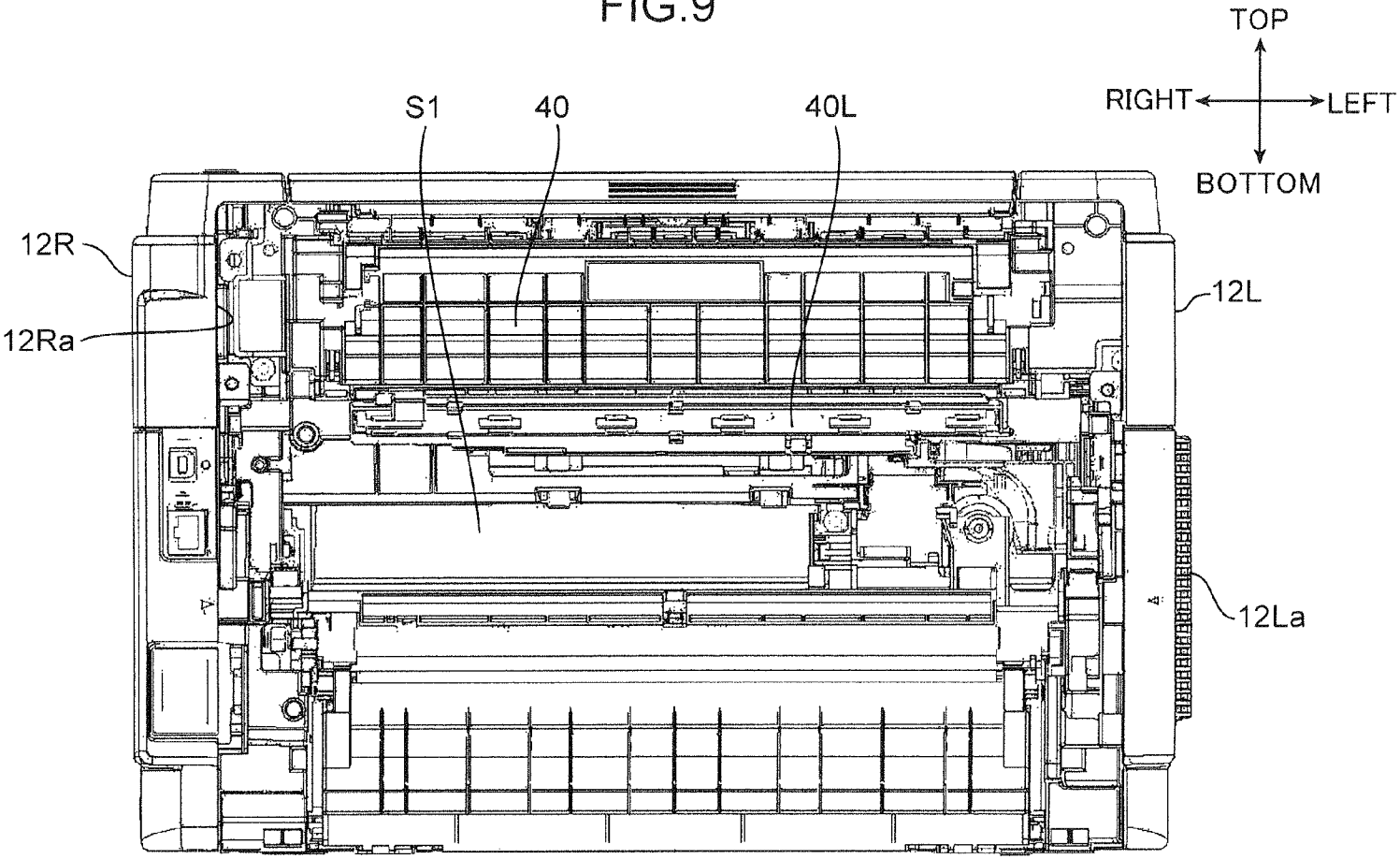
FIG. 9 is a diagram showing the back of the inside of the image forming apparatus according to the embodiment of the present disclosure, in which the waste toner bottle is not mounted.
Figure 10:
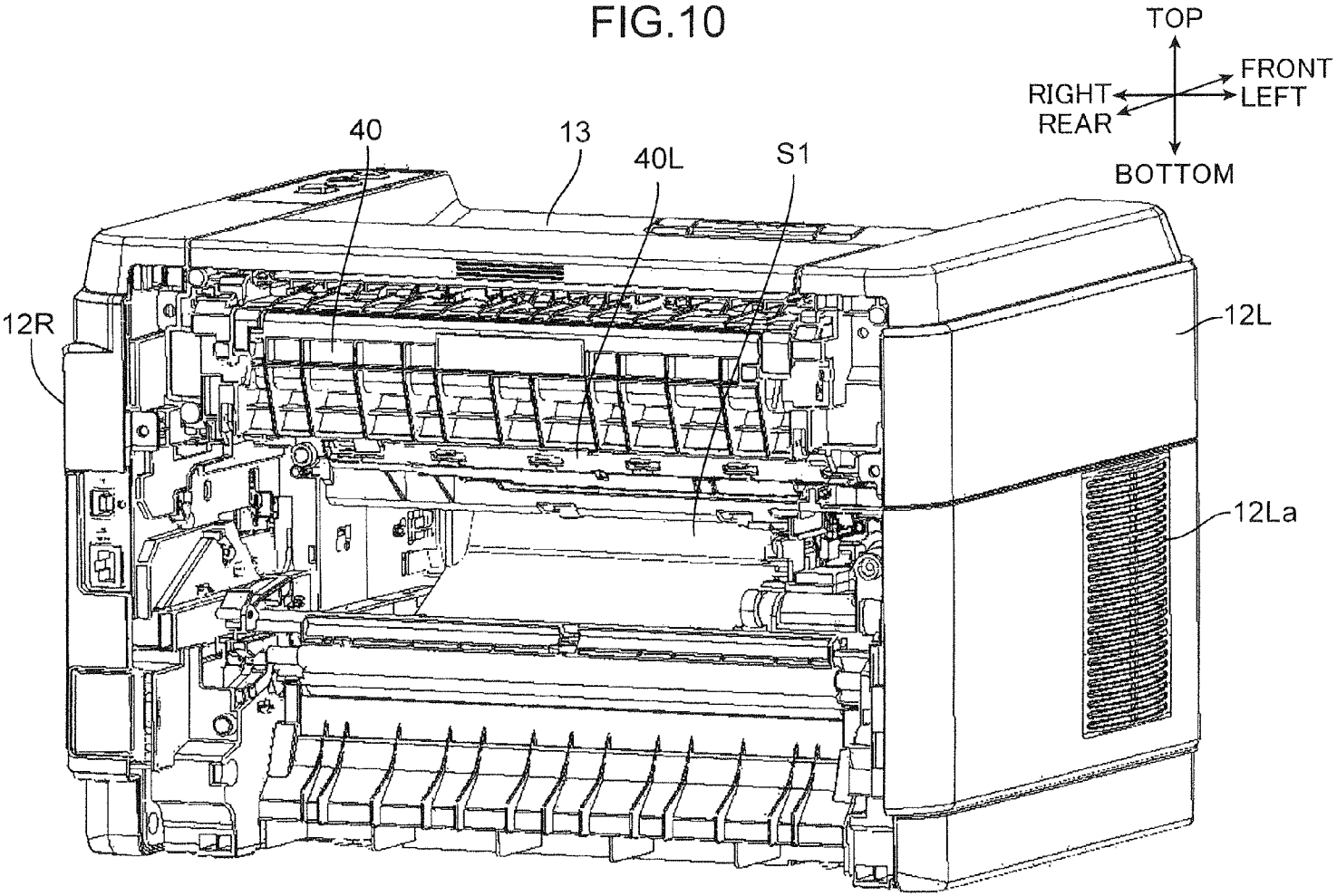
FIG. 10 is a perspective view showing the back of the inside of the image forming apparatus according to the embodiment of the present disclosure, in which the waste toner bottle is not mounted.
Figure 11:
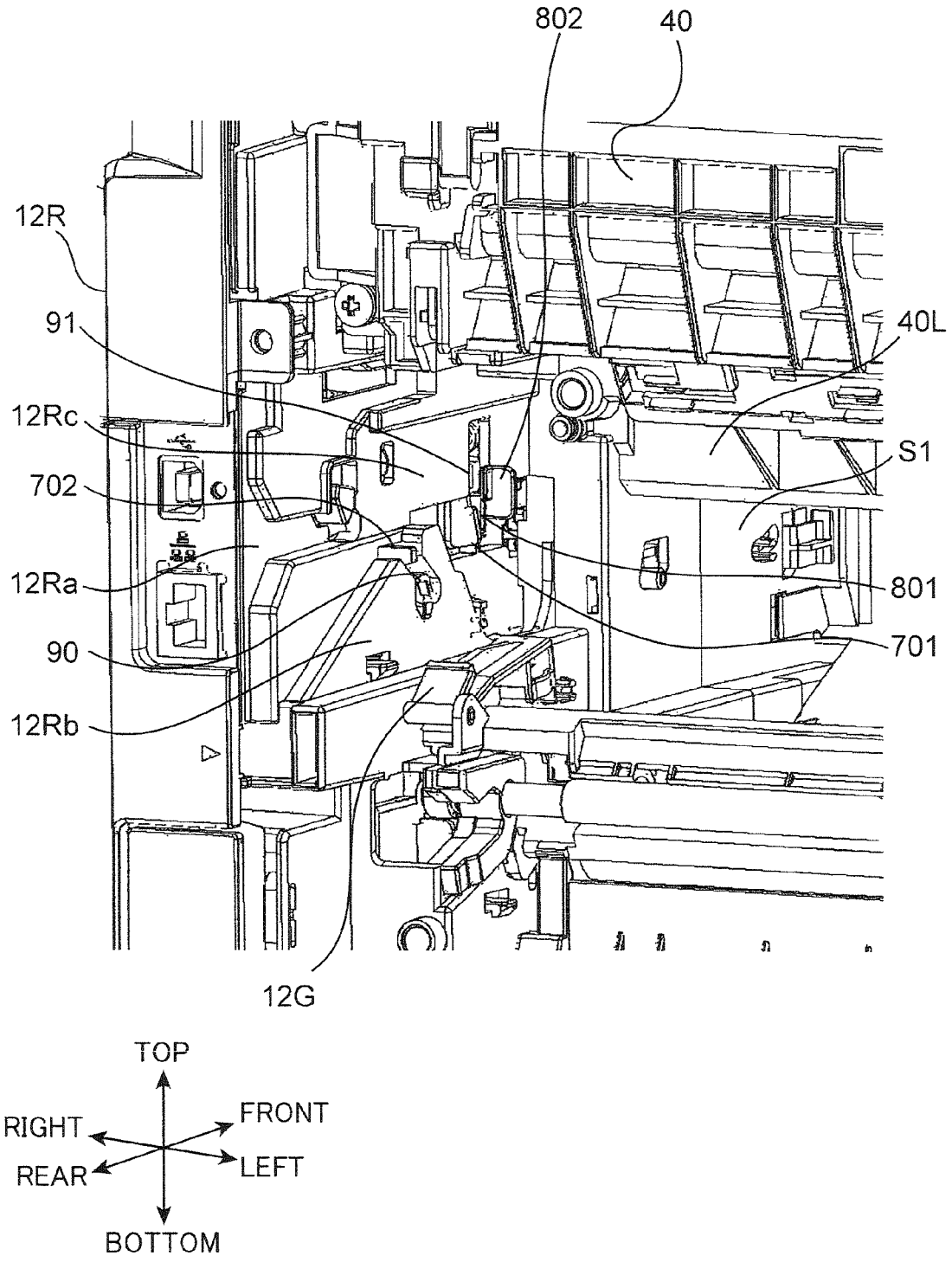
FIG. 11 is an enlarged perspective view showing the inside of the image forming apparatus according to the embodiment of the present disclosure, in which the waste toner bottle is not mounted.
Figure 12:
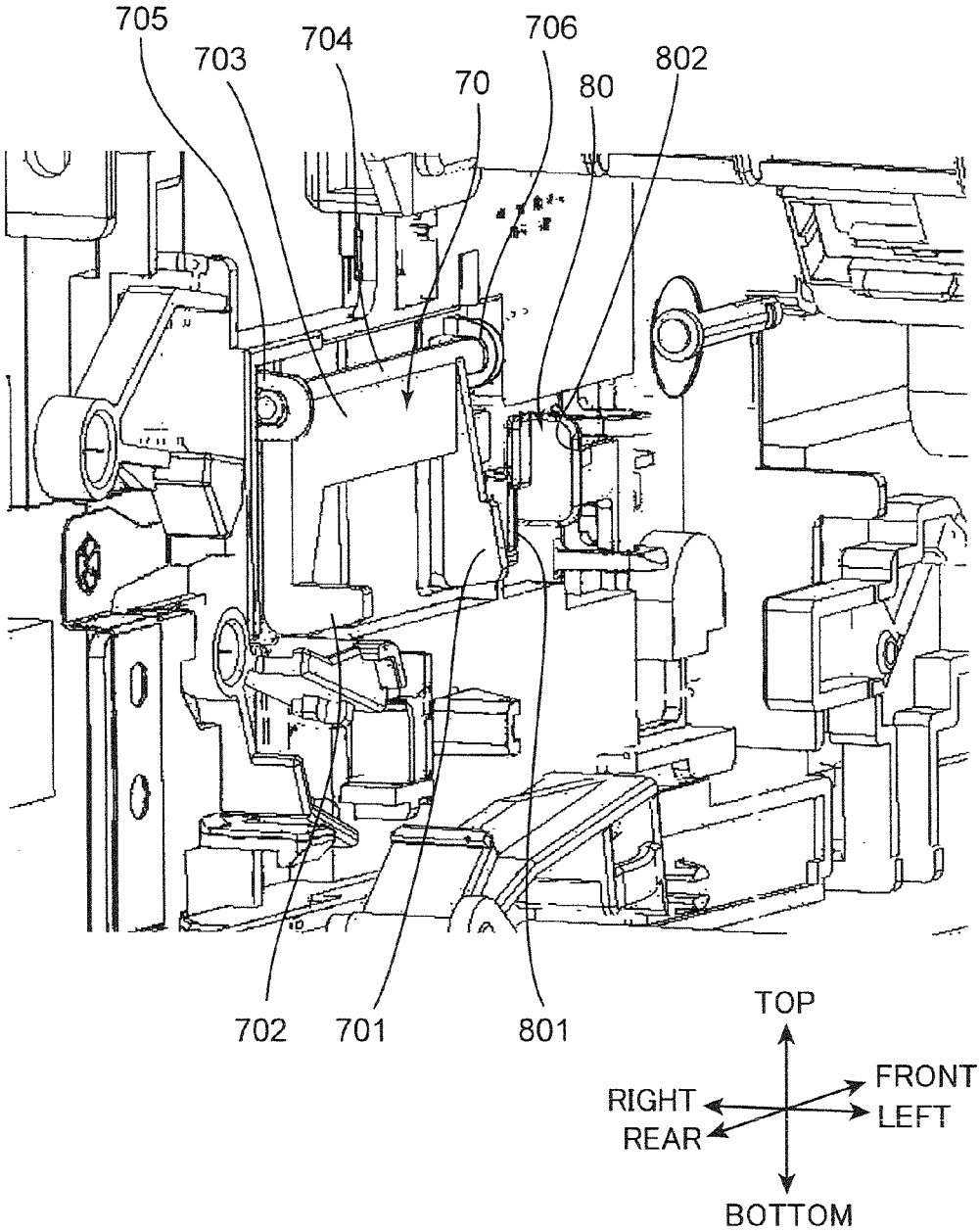
FIG. 12 is an enlarged perspective view showing the inside of the image forming apparatus according to the embodiment of the present disclosure, in which the waste toner bottle is not mounted.
Figure 13:
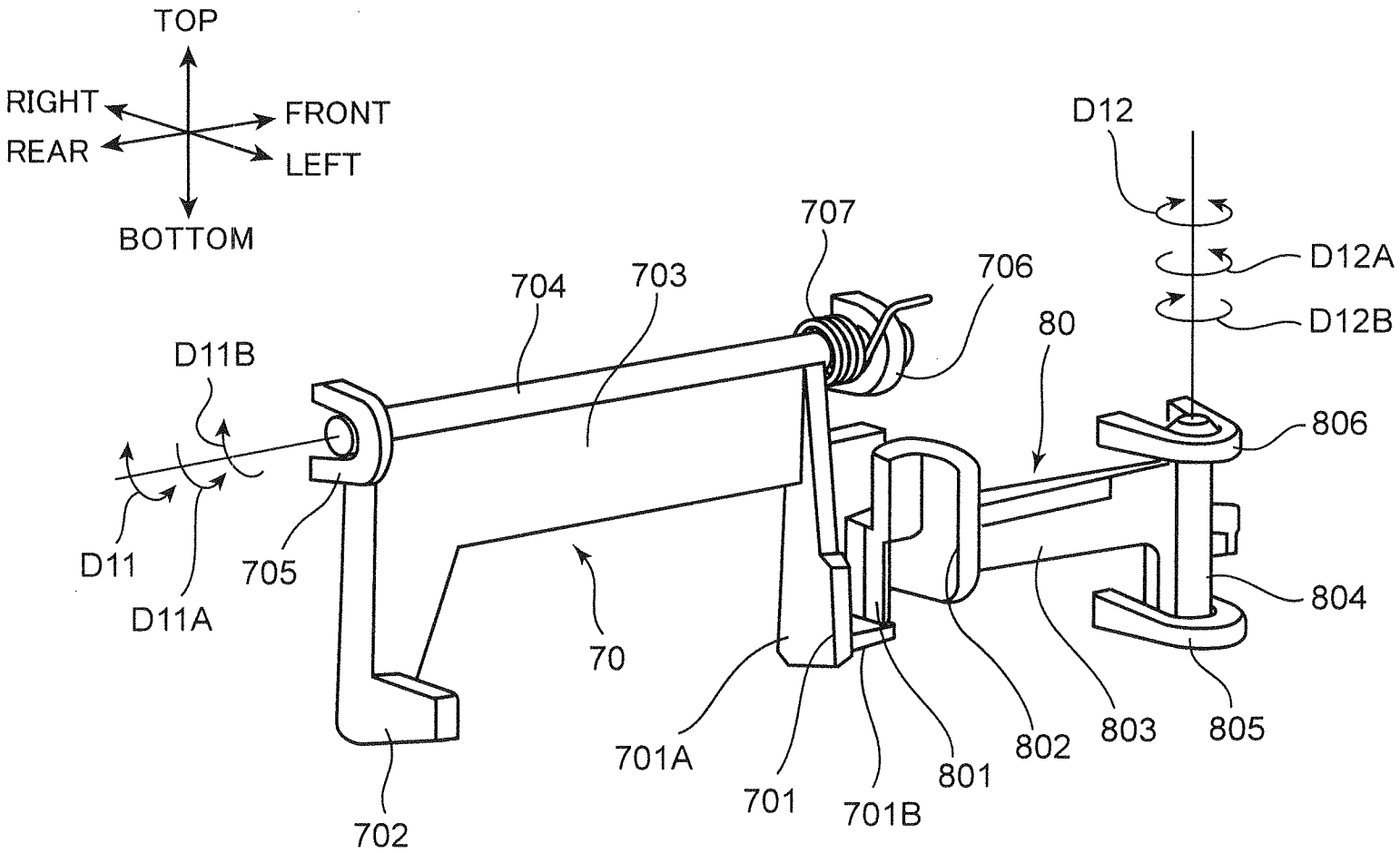
FIG. 13 is an enlarged perspective view of a regulating member in a state in which the waste toner bottle is not mounted in the image forming apparatus according to the embodiment of the present disclosure.
Figure 14:
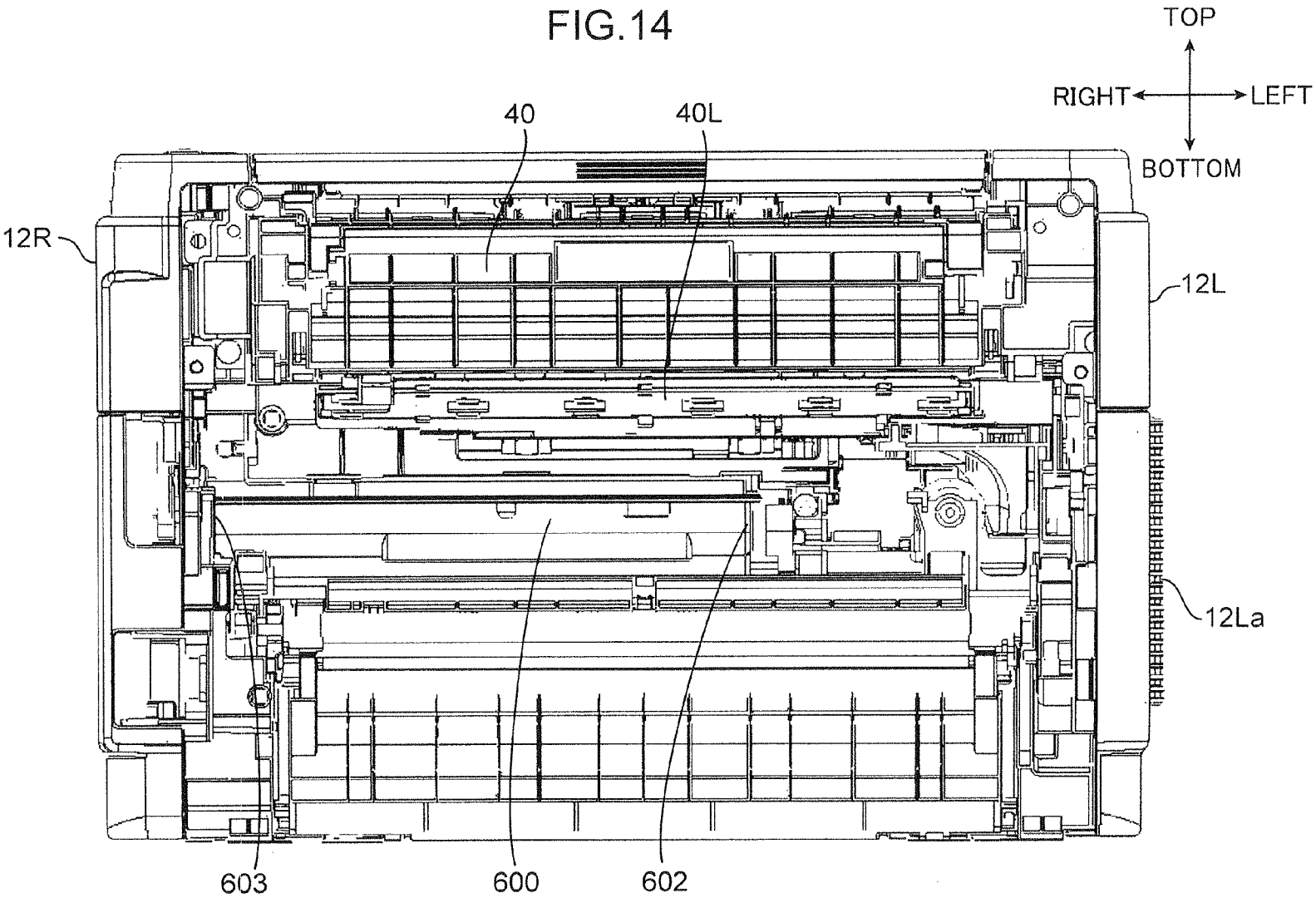
FIG. 14 is a diagram showing the back of the inside of the image forming apparatus according to the embodiment of the present disclosure, in which the waste toner bottle is mounted.
Figure 15:
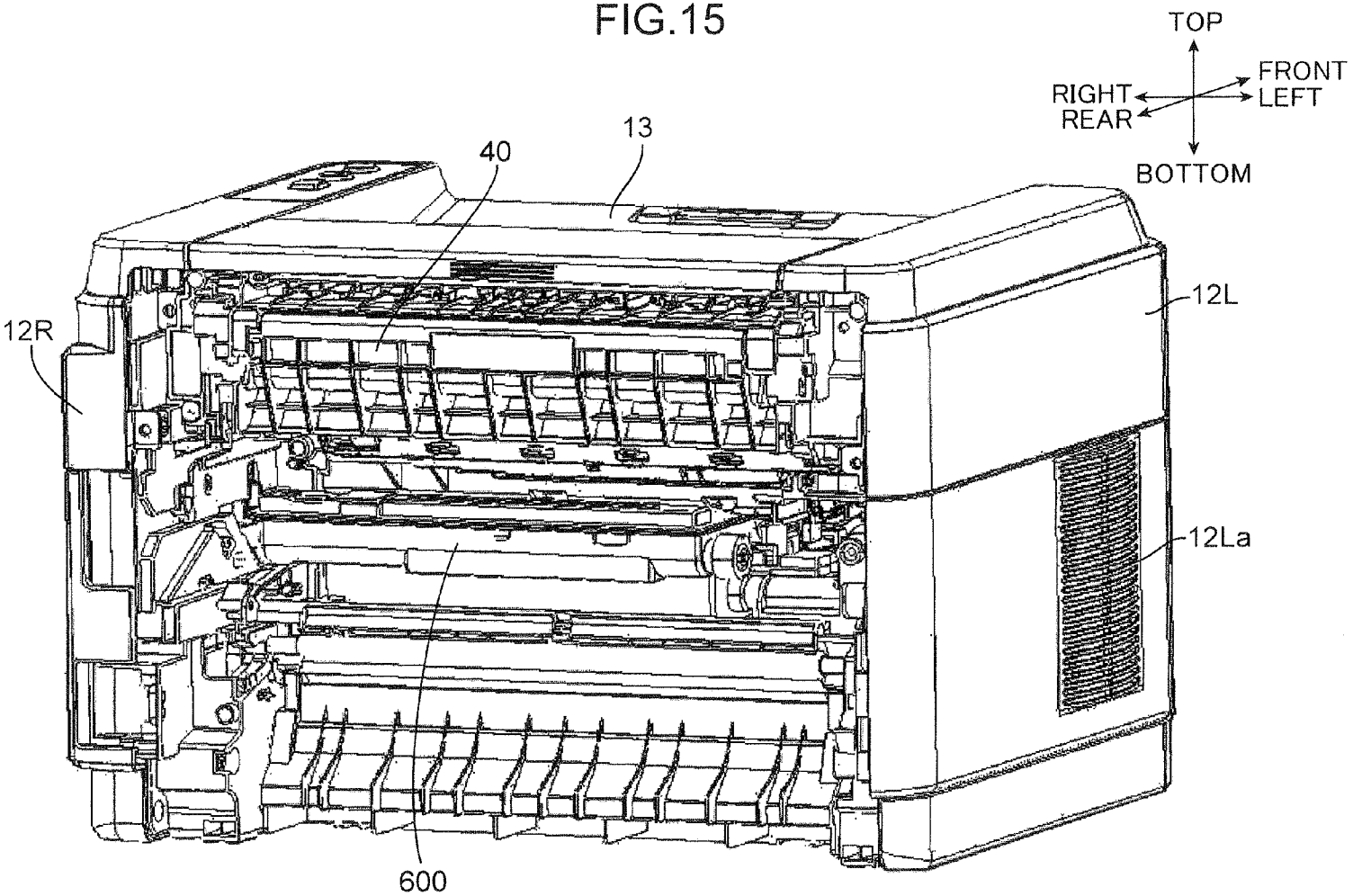
FIG. 15 is a perspective view showing the back of the inside of the image forming apparatus according to the embodiment of the present disclosure, in which the waste toner bottle is mounted.
Figure 16:
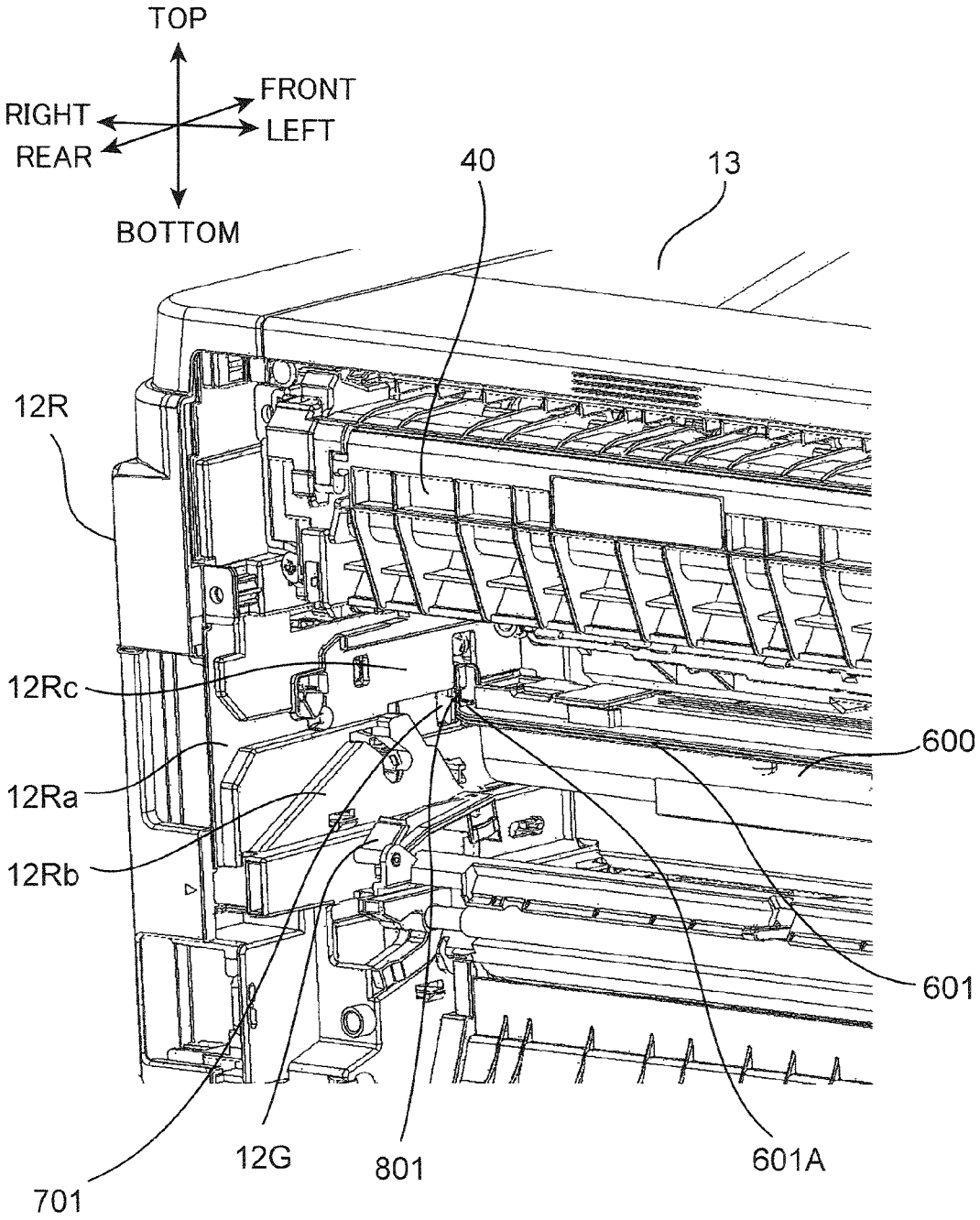
FIG. 16 is a diagram showing the back of the inside of the image forming apparatus according to the embodiment of the present disclosure, in which the waste toner bottle is mounted.
Figure 17:
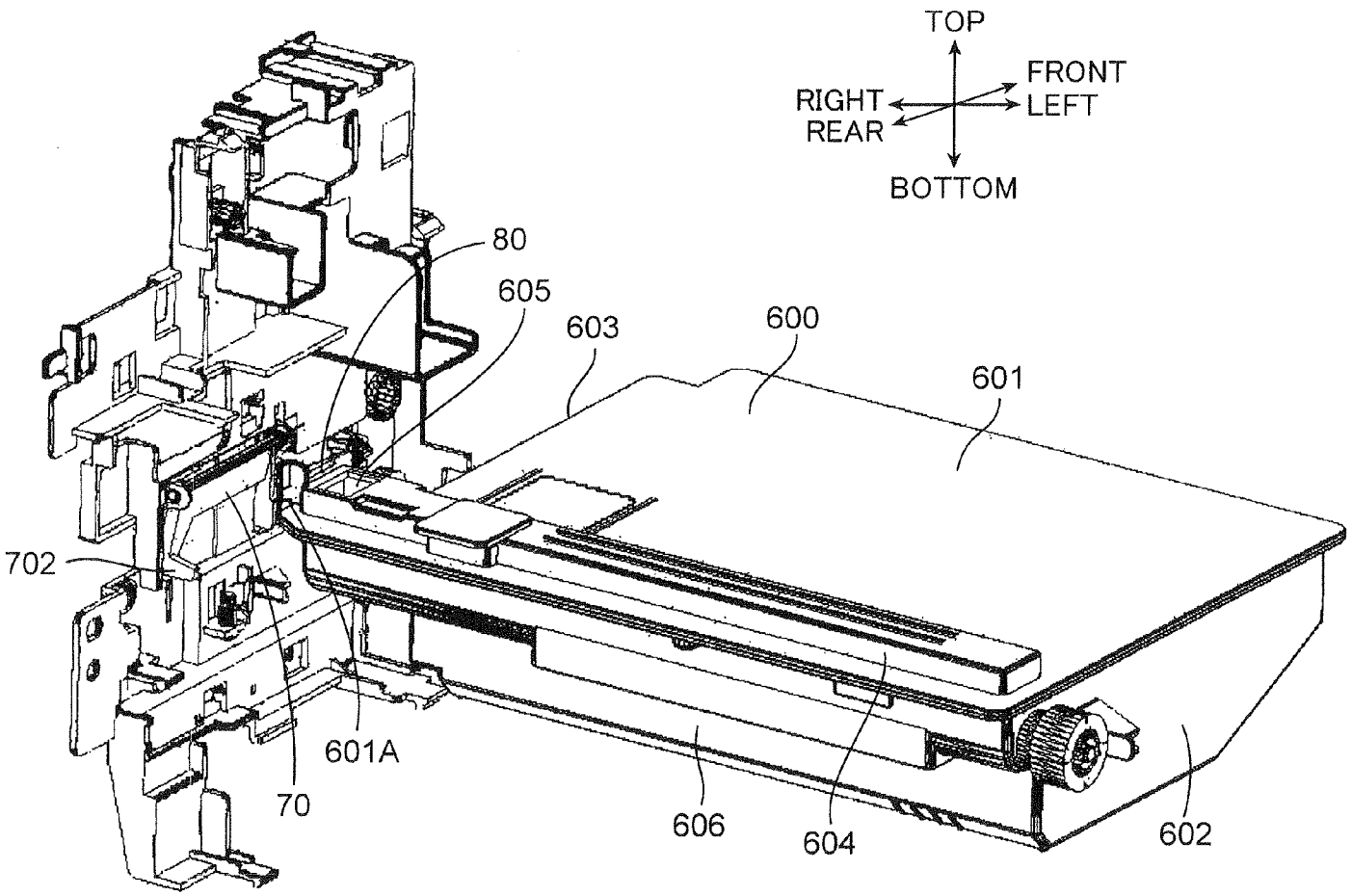
FIG. 17 is a perspective view showing the back of a part of the inside of the image forming apparatus according to the embodiment of the present disclosure, in which the waste toner bottle is mounted.

Next, the structure for mounting each of the units according to the present embodiment is described in further detail with reference to FIGS. 9 to 17. FIG. 9 is a diagram showing the back of the inside of the main body housing 10, in which the waste toner bottle 600 is not mounted. FIG. 10 is a perspective view of FIG. 9, in which the waste toner bottle 600 is not mounted. FIG. 11 is an enlarged perspective view showing an enlargement of a part of the internal space, in which the waste toner bottle 600 is not mounted. FIG. 12 is an enlarged perspective view showing a state in which a right inner wall section 12Ra is removed from the state shown in FIG. 11. FIG. 13 is a perspective view showing a further enlargement of the part shown in FIG. 12. FIGS. 14, 15 and 16 are diagrams each showing a state in which the waste toner bottle 600 is mounted in each of the states shown in FIGS. 9, 10 and 11. FIG. 17 is a perspective view showing a peripheral structure of the waste toner bottle 600.

In relation to FIGS. 9 and 10, the waste toner bottle 600 is mounted in the first position S1 (see FIGS. 3, 4) by opening the rear cover 12 (the wall section) of the main body housing 10, as shown in FIGS. 14 and 15. The waste toner bottle 600 is disposed in a position shifted towards the right cover 12R (the side wall). With reference to FIG. 11, the right inner wall section 12Ra corresponding to an inner wall section of the right cover 12R is disposed on the inside of the right cover 12R of the main body housing 10. The right inner wall section 12Ra has first and second projecting walls 12Rb and 12Rc protruding leftward from the right inner wall section 12Ra. The first and second projecting walls 12Rb and 12Rc are formed such that a part of the right inner wall section 12Ra rises to the left. A first groove section 90 is disposed on the first projecting wall 12Rb. The first groove section 90 is formed in such a manner as to extend forward and downward from an upper end section of the first projecting wall 12Rb. A second groove section 91 is disposed on the second projecting wall 12Rc. The second groove section 91 extends vertically at a lower end of the second projecting wall 12Rc.

A development regulator 702 protruding leftward is disposed in an upper end section of the first groove section 90. A first pressed piece 701, a second pressed piece 801, and a drum regulator 802 similarly protruding leftward are disposed in a lower portion of the second groove section 91.

The first pressed piece 701 (a first pressed section), the development regulator 702 (the first regulating member), the second pressed piece 801, and the drum regulator 802 (the second regulating member) are described in detail with reference to FIGS. 12 and 13. A development regulating member 70 and a drum regulating member 80 are exposed by removing the right inner wall section 12Ra (including the first projecting wall 12Rb and the second projecting wall 12Rc) shown in FIG. 11.

The development regulating member 70 is disposed on the outside (right-hand side) of the right inner wall section 12Ra. The development regulating member 70 regulates mounting of the developing unit 330 in the second position S2, in a state in which the waste toner bottle 600 is not mounted in the first position S1. The development regulating member 70 has the first pressed piece 701, the development regulator 702, a first coupling section 703 (a coupling piece), and a first rotating shaft 704.

As described above, the first pressed piece 701 is a plate-like member that projects leftward under the second groove section 91 of the second projecting wall 12Rc. The first pressed piece 701 has a side surface 701A. The side surface 701A is in a substantially triangular shape having an upper end as the apex and intersects with a direction in which the waste toner bottle 600 is mounted in the first position (forward direction). Once the waste toner bottle 600 is mounted in the first position S1, the first pressed piece 701 is pressed to the right by the waste toner bottle 600. The first pressed piece 701 also has a projecting piece 701B. The projecting piece 701B is a plate-like member protruding forward from the side surface 701A.

The development regulator 702 is disposed so as to face the first pressed piece 701. The development regulator 702 is disposed behind the first pressed piece 701 so as to face the side surface 701A of the first pressed piece 701. The development regulator 702 is a plate-like member projecting leftward. The development regulator 702 is capable of changing its state between a first state in which the development regulator 702 projects to the second insertion path F2 when the waste toner bottle 600 is not mounted in the first position S1, and a second state in which the development regulator 702 retracts from the second insertion path F2 when the waste toner bottle 600 is mounted in the first position S1.

The first coupling section 703 is a plate-like member having a plane surface along a horizontal direction (facing the right-left direction) and extending in the front-back direction. The first coupling section 703 couples the first pressed piece 701 and the development regulator 702 to each other in the front-back direction. As a result, the first pressed piece 701 and the development regulator 702 protrude from the first coupling section 703 in the same direction (to the left).

The first rotating shaft 704 is provided at an upper end of the first coupling section 703 and extends in the front-back direction. The first rotating shaft 704 is provided so as to project to the front of the first pressed piece 701 and to the back of the development regulator 702 by a predetermined length.

First and second bearing sections 705 and 706, a pair of bearings with internal holes, are disposed in a predetermined section on the right-hand side of the second projecting wall 12Rc (FIG. 11). By inserting either end of the first rotating shaft 704 to the first bearing section 705 and the second bearing section 706, the development regulating member 70 can be turned in a direction of an arrow D11 shown in FIG. 13. A helical torsion coil spring 707 (a biasing section) is disposed in a portion of the first rotating shaft 704 closer to the second bearing section 706. The helical torsion coil spring 707 is wound around the first rotating shaft 704 and engaged with the second bearing section 706, with a predetermined level of elastic force accumulated thereon. The helical torsion coil spring 707 biases the development regulating member 70 such that the development regulator 702 projects leftward (arrow D11A) from the first groove section 90 (FIG. 11) to the second insertion path F2. When the development regulator 702 projects to the second insertion path F2, the development regulator 702 interferes with the developing unit 330.

The drum regulating member 80 is disposed to the right-hand side of the right inner wall section 12Ra. The drum regulating member 80 regulates mounting of the drum unit 350 in the third position S3, in a state in which the waste toner bottle 600 is not mounted in the first position S1. The drum regulating member 80 has the second pressed piece 801, the drum regulator 802, a second coupling section 803, and a second rotating section 804.

As described above, the second pressed piece 801 is a plate-like member projecting leftward under the second groove section 91 of the second projecting wall 12Rc. The second pressed piece 801 has a surface that intersects with the direction in which the waste toner bottle 600 is mounted in the first position S1 (forward direction). This surface has a substantially rectangular shape. When the waste toner bottle 600 is mounted in the first position S1, the second pressed piece 801 is pressed to the right by the waste toner bottle 600.

The drum regulator 802 (the second regulating member) is disposed facing the second pressed piece 801. The drum regulator 802 is disposed on the front side of the second pressed piece 801, with a small gap therebetween. The drum regulator 802 is a plate-like member extending leftward. The drum regulator 802 is capable of changing its state between a third state in which the drum regulator 802 projects to the third insertion path F3 when the waste toner bottle 600 is not mounted in the first position S1, and a fourth state in which the drum regulator 802 retracts from the third insertion path F3 when the waste toner bottle 600 is mounted in the first position S1.

The second coupling section 803 is a plate-like member having a plane surface along the horizontal direction and extending in the front-back direction. The second coupling section 803 couples the second pressed piece 801 and the drum regulator 802 to each other in the front-back direction. The second coupling section 803 further extends forward to the front of the drum regulator 802.

The second rotating shaft 804 is stretched vertically in a front-side tip end portion of the second coupling section 803. The second rotating shaft 804 is provided so as to project from a vertical end portion of the second coupling section 803 by a predetermined length in the vertical direction.

Third and fourth bearing sections 805 and 806, a pair of bearings with internal holes, are disposed in a predetermined section on the right-hand side of the second projecting wall 12Rc (FIG. 11), with a vertical interval therebetween. By inserting either end of the second rotating shaft 804 to the third bearing section 805 and the fourth bearing section 806, the drum regulating member 80 can be turned in a direction of an arrow D12 shown in FIG. 13. The projecting piece 701B of the development regulating member 70 described above is provided so as to be able to come into abutment with a right side surface of the second pressed piece 801. The projecting piece 701B of the development regulating member 70 biased in a direction of an arrow D11A by the helical torsion coil spring 707 presses the second pressed piece 801 leftward (arrow D12A). As a result, the second pressed piece 801 and the drum regulator 802 project leftward under the second groove section 91 (FIG. 11) due to the biasing force of the helical torsion coil spring 707. In this case, while the second pressed piece 801 projects to the first insertion path F1, the drum regulator 802 projects to the third insertion path F3. When the drum regulator 802 projects to the third insertion path F3, the drum regulator 802 interferes with the drum unit 350.

With reference to FIG. 11, the development regulating member 70 and the drum regulating member 80 that are configured as described above are provided to the right-hand side of the right inner wall section 12Ra. As shown in FIG. 17, the waste toner bottle 600 has a top panel 601, a left wall section 602, a right wall section 603, an upper end section 604, and an opening section 605. The top panel 601 is a flat plate member stretched in the front-back and right-left directions. The rear of the waste toner bottle 600 is defined by the left wall section 602 and the right wall section 603 constituting a pair of side walls extending downward from the top panel 601, and a rear wall 606 connecting this pair of side walls on the rear side. The upper end section 604 is provided so as to extend in the right-left direction in a rear-side end portion of the top panel 601. The upper end section 604 configures a portion where a part of a space formed inside the waste toner bottle 600 projects upward, and the opening section 605 that opens upward is disposed in the right-side end portion of the upper end section 604. Waste toner is discharged to the inside of the waste toner bottle 600 from a toner discharge path, which is not shown, via the opening section 605.

When the waste toner bottle 600 is mounted in the first position S1 shown FIG. 3, a right-side end section 601A of the top panel 601 of the waste toner bottle 600 presses the first pressed piece 701 and the second pressed piece 801 rightward. As a result, the development regulating member 70 and the drum regulating member 80 are moved in directions of arrows D11B and D12B, respectively, as shown in FIG. 13. In other words, the movements of the first pressed piece 701 and the second pressed piece 801 are transmitted to the development regulator 702 and the drum regulator 802 via the first coupling section 703 and the second coupling section 803, respectively. As a result, the development regulator 702 and the drum regulator 802 are moved to the right (in a direction in which the development regulator 702 and the drum regulator 802 are retracted to the right inner wall section 12Ra) in the first groove section 90 and the second groove section 91. In this case, the development regulator 702 and the drum regulator 802 retract from the second insertion path F2 and the third insertion path F3, respectively.

Figure 18:
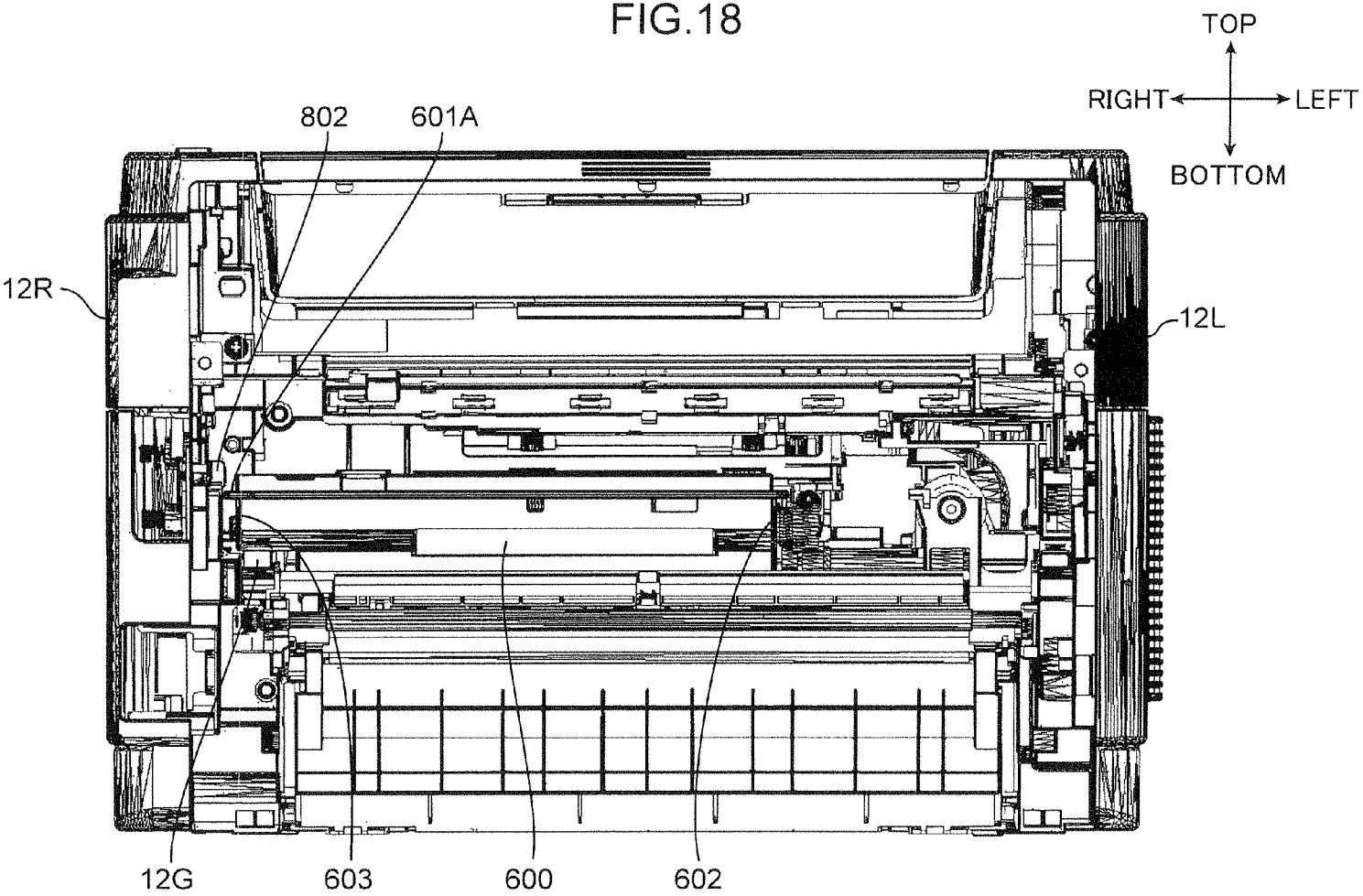
FIG. 18 is a diagram showing the back of the inside of the image forming apparatus according to the embodiment of the present disclosure, when the waste toner bottle is being mounted.
Figure 19:
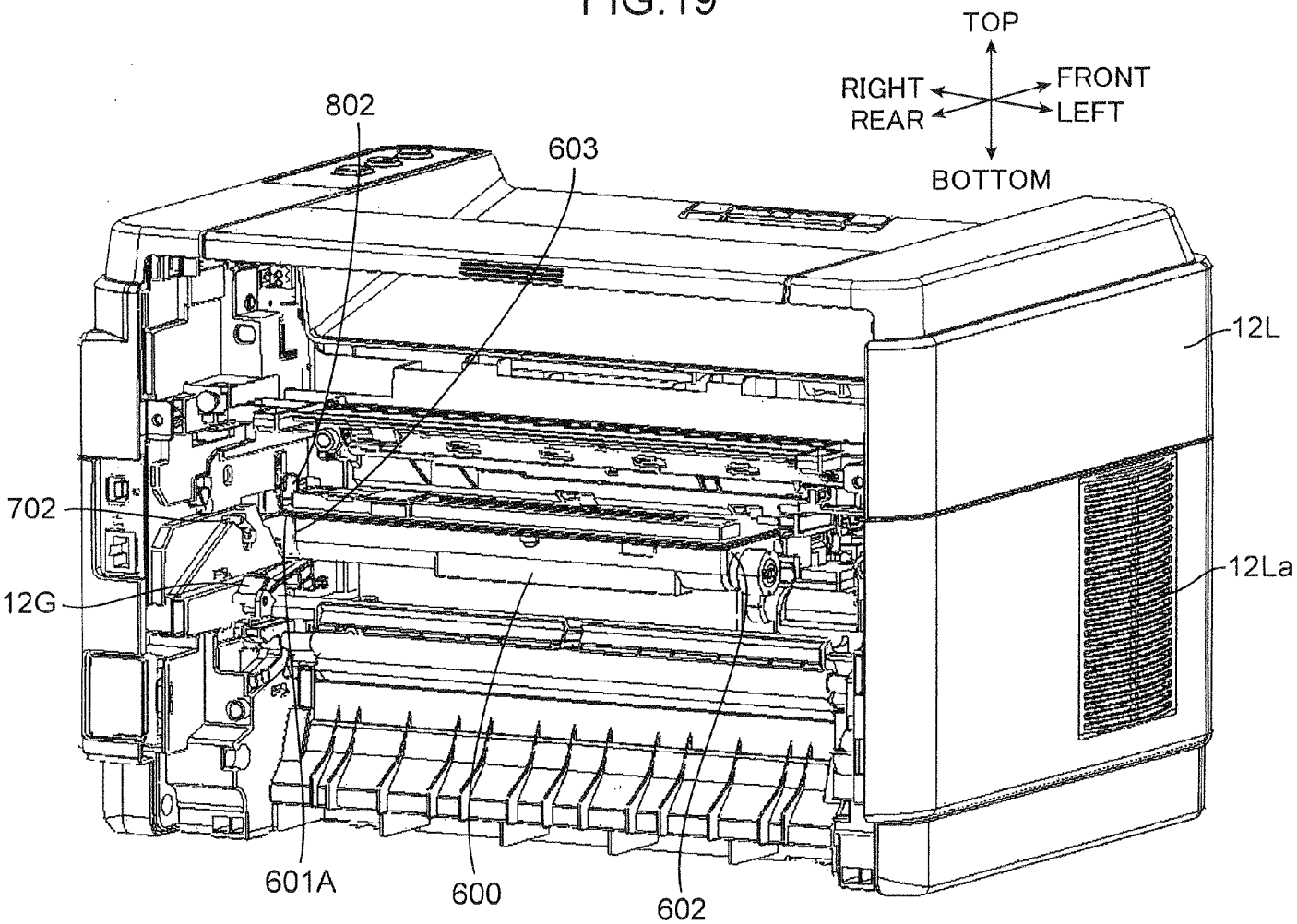
FIG. 19 is a perspective view showing the back of the inside of the image forming apparatus according to the embodiment of the present disclosure, when the waste toner bottle is being mounted.

Note that a characteristic of the present embodiment is the direction of mounting the waste toner bottle 600 because the right-side end section 601A of the top panel 601 of the waste toner bottle 600 securely presses the first pressed piece 701 and the second pressed piece 801. FIG. 18 is a diagram showing from behind a situation obtained immediately before the waste toner bottle 600 is mounted in the first position S1 of the internal space S. FIG. 19 is a rear perspective view of the situation shown in FIG. 18.

When the waste toner bottle 600 is inserted into the first insertion path F1 of the internal space S towards the first position S1, the waste toner bottle 600 is guided by a guide member 12G (a guide section). The guide member 12G is disposed below the first projecting wall 12Rb. The guide member 12G is a plate-like member aligned vertically and provided to extend in the front-back direction. A projecting piece, not shown, which inclines toward the first projecting wall 12Rb, is disposed in the guide member 12G. The waste toner bottle 600 is moved forward along the first insertion path F1, while the right-side end section 601A of the top panel 601 is separated from the first pressed piece 701 and the second pressed piece 801 in the horizontal direction, with a predetermined interval therebetween. Immediately before the waste toner bottle 600 is mounted in the first position S1, the waste toner bottle 600 is guided forward and rightward by the guide member 12G. As a result, the right-side end section 601A of the top panel 601 of the waste toner bottle 600 can securely press the first pressed piece 701 and the second pressed piece 801 rightward (toward the right cover 12R of the main body housing 10).

As described above, in the present embodiment, the first pressed piece 701 of the development regulating member 70 and the second pressed piece 801 of the drum regulating member 80 are pressed rightward when the waste toner bottle 600 is mounted in the first position S1. In linkage with this, the development regulator 702 and the drum regulator 802 are moved rightward. Next is described the relationship of the operations of the development regulating member 70 and the drum regulating member 80 to mounting the developing unit 330 and the drum unit 350.

Figure 20:
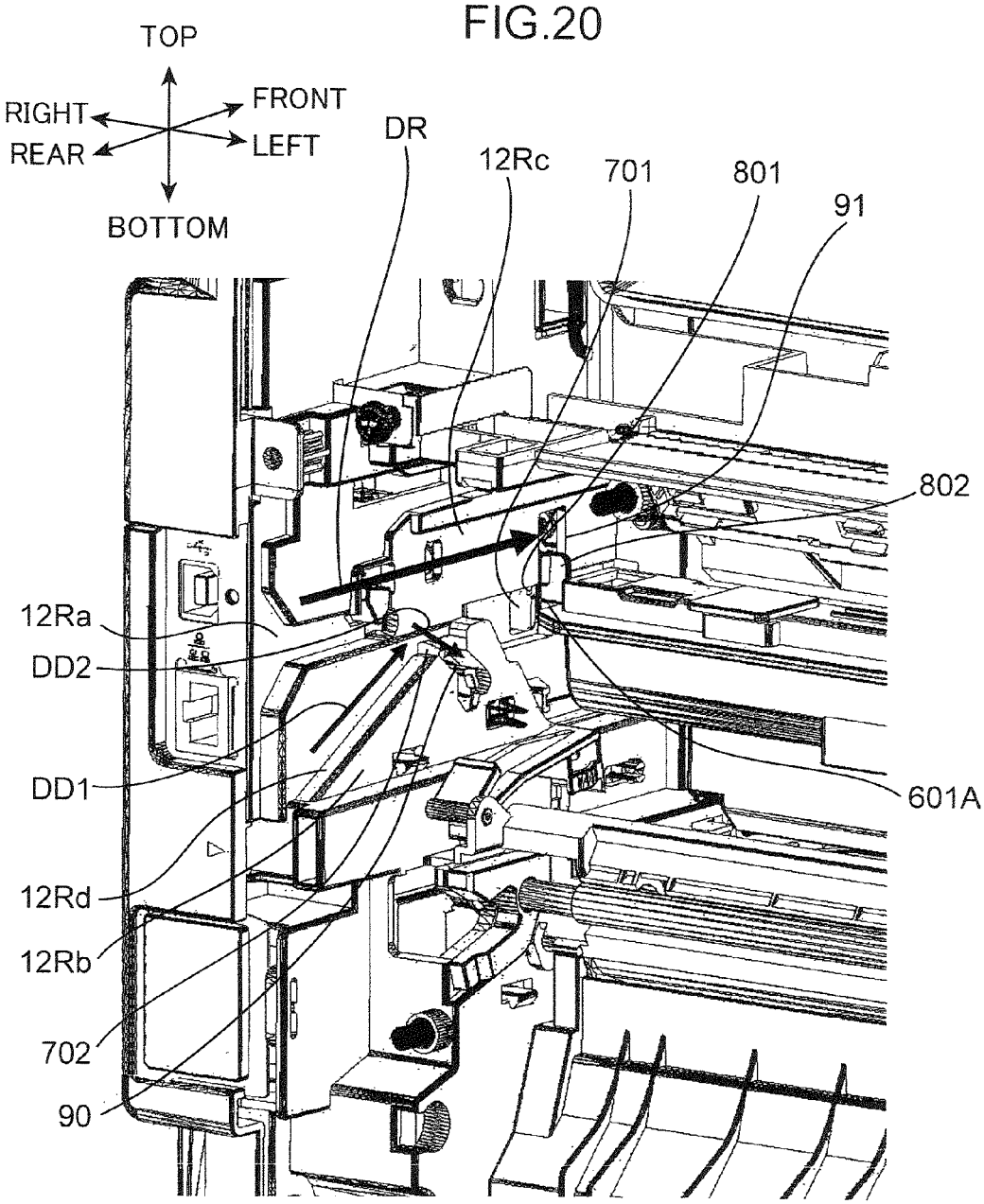
FIG. 20 is an enlarged perspective view showing paths along which the developing device and the drum unit are mounted in the image forming apparatus according to the embodiment of the present disclosure.
Figure 21:
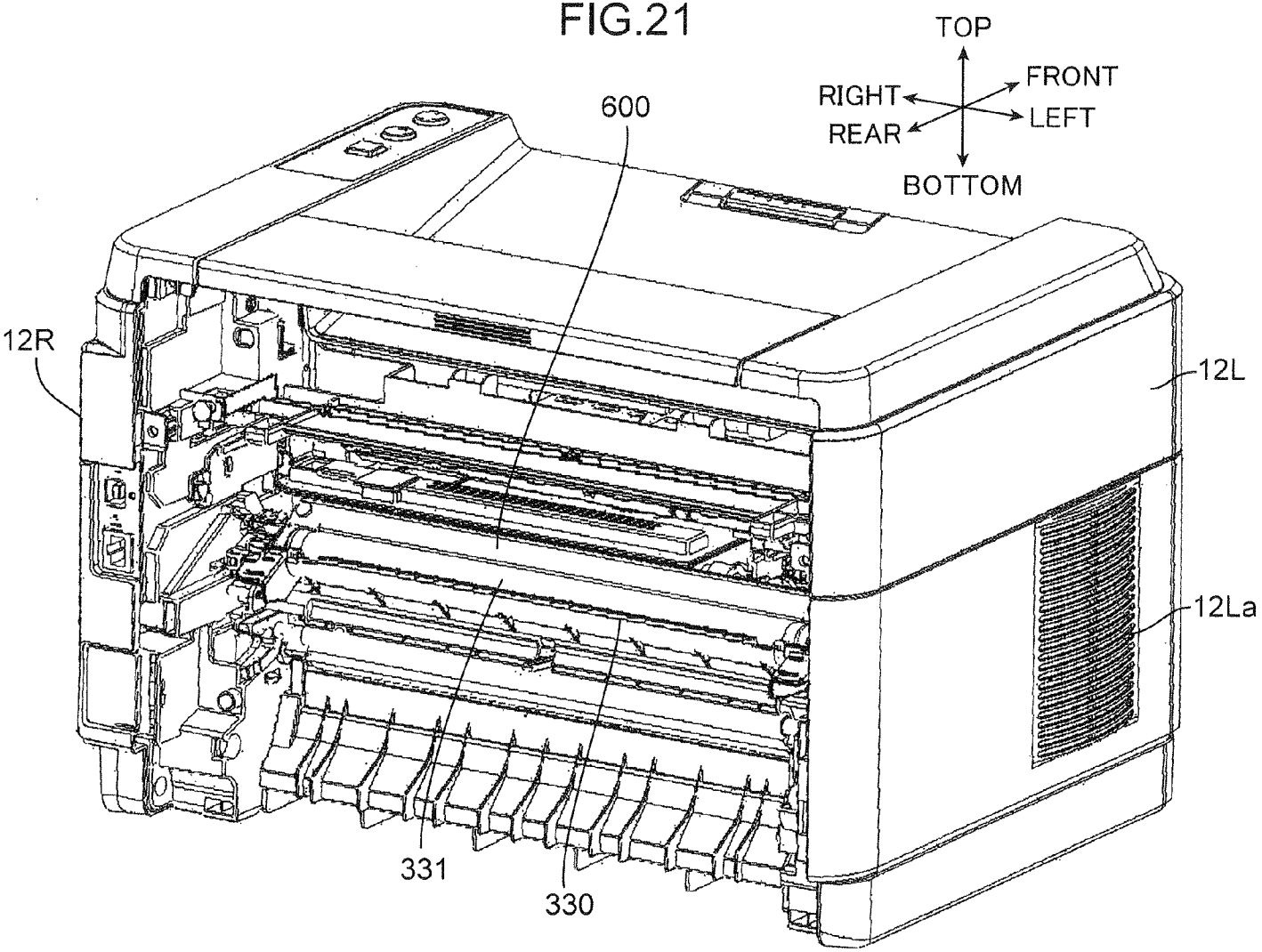
FIG. 21 is a perspective view showing the inside of the image forming apparatus according to the embodiment of the present disclosure, in which the waste toner bottle and the developing device are mounted.
Figure 22:
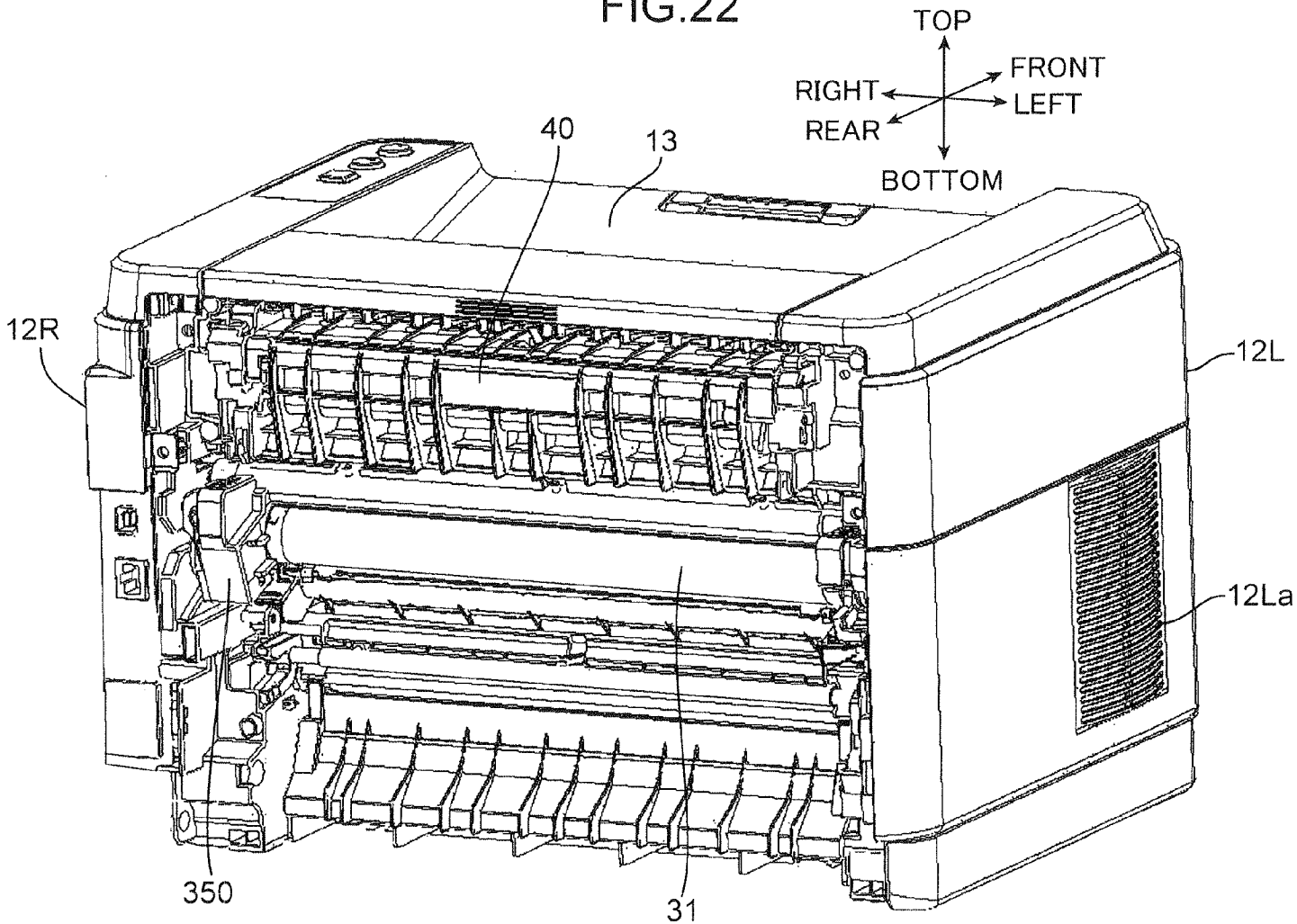
FIG. 22 is a perspective view showing the back of the inside of the image forming apparatus according to the embodiment of the present disclosure, in which the waste toner bottle, the developing device, and the drum unit are mounted.

FIG. 20 is an enlarged perspective view showing the insertion paths of the developing unit 330 and the drum unit 350 in the main body housing 10. FIG. 21 is a perspective view showing the back of the waste toner bottle 600 and the developing unit 330 mounted in the internal space S. FIG. 22 is a perspective view showing the back of the waste toner bottle 600, the developing unit 330, and the drum unit 350 mounted in the internal space S.

With reference to FIG. 20, when the developing unit 330 is mounted in the second position S2 in the internal space S (FIG. 5), an interfered section, not shown, which protrudes rightward from a right side surface of the developing unit 330, is guided forward and upward (arrow DD1) by the upper wall 12Rd of the first projecting wall 12Rb. The upper wall 12Rd of the first projecting wall 12Rb is a member configuring the second insertion path F2. When the developing unit 330 is inserted further forward, the interfered section mentioned above enters the first groove section (arrow DD2). Once the interfered section reaches a lower end of the first groove section 90, the developing unit 330 is mounted in the second position S2 completely. Note that the structures of the interfered section protruding from the developing unit 330, the upper wall 12Rd of the first projecting wall 12Rb, and the first groove section 90 are provided similarly on the left-hand side of the developing unit 330 and the inside of the left cover 12L as well (not shown).

When mounting the developing unit 330 in the second position S2, mounting the waste toner bottle 600 in the first position S1 beforehand establishes the state in which the development regulator 702 is embedded inside the first groove section 90, i.e., the state in which the development regulator 702 retracts from the second insertion path F2 (the second state). Accordingly, the projecting section of the developing unit 330 inserted into the internal space S does not come into abutment against the development regulator 702. Therefore, the developing unit 330 can be mounted in the second position S2, as shown in FIG. 21. In other words, in the case in which the waste toner bottle 600 is not mounted in the first position S1, the state is established in which the development regulator 702 projects to the second insertion path F2 in the first groove section 90 (the first state). Consequently, the projecting section of the developing unit 330 inserted in the internal space S comes into abutment against (interferes with) the development regulator 702, preventing the developing unit 330 from being mounted in the second position S2. Therefore, only in the case where the waste toner bottle 600 is mounted in the first position S1 located further back than the developing unit 330 in the internal space S, the developing unit 330 can be mounted in the second position S2. The developing unit 330 therefore is not mounted in the second position S2 when a worker forgets to mount the waste toner bottle 600 in the first position S1 when mounting each unit in the internal space S.

Similarly, when mounting the drum unit 350 in the third position S3 (FIG. 7) of the internal space S (a direction of an arrow DR) as shown in FIG. 20, the front end section 350A of the drum unit 350 enters between a frame front section 40L1 of the third frame 40L and the rear end section 600C of the waste toner bottle 600. In this case, mounting the waste toner bottle 600 in the first position S1 beforehand establishes the state in which the drum regulator 802 is moved rightward at the second groove section 91. In this state, the drum regulator 802 retracts from the third insertion path F3 through which the drum unit 350 is inserted (the fourth state). Accordingly, the front end section 350A of the drum unit 350 inserted into the internal space S does not come into abutment against the drum regulator 802. Therefore, the drum unit 350 can be mounted in the third position S3, as shown in FIG. 22. In other words, in the case in which the waste toner bottle 600 is not mounted in the first position S1, the drum regulator 802 projects from the second groove section 91 to the third insertion path F3 (the third state). Consequently, the front end section 350A of the drum unit 350 inserted in the internal space S comes into abutment against (interferes with) the drum regulator 802, preventing the drum unit 350 from being mounted in the third position S3. Therefore, only in the case where the waste toner bottle 600 is mounted in the first position S1 located further back than the drum unit 350 in the internal space S, the drum unit 350 can be mounted in the third position S3. The drum unit 350 therefore is not mounted in the third position S3 when the worker forgets to mount the waste toner bottle 600 in the first position S1. Furthermore, it is not necessary to provide a special unit detector for detecting whether the waste toner bottle 600 is mounted in the first position S1 or not.

As described above, in the present embodiment, when mounting the plurality of units in the internal space S of the image forming apparatus 1, mounting the developing unit 330 and the drum unit 350 is regulated depending on how the waste toner bottle 600 is mounted. It is, therefore, not necessary to provide a detector for detecting whether the waste toner bottle 600 is mounted in the internal space S or not. Moreover, in the present embodiment, the members that are originally installed in the image forming apparatus 1 are favorably used for determining whether the developing unit 330 or the drum unit 350 is mounted in the image forming apparatus 1 or not.

Further, in the present embodiment, in linkage with mounting of the waste toner bottle 600 in the first position S1, the development regulating member 70 and the drum regulating member 80 cause the development regulator 702 and the drum regulator 802 to retract from the second insertion path F2 and the third insertion path F3 respectively. Consequently, in conjunction with mounting of the waste toner bottle 600, the developing unit 330 and the drum unit 350 can reliably be mounted in the second position S2 and the third position S3 respectively.

Additionally, in the present embodiment, the development regulator 702 and the drum regulator 802 project to the second insertion path F2 and the third insertion path F3 respectively, in a direction intersecting with an insertion direction of inserting the developing unit 330 and the drum unit 350. As a result, mounting the developing unit 330 or the drum unit 350 in the second position S2 or the third position S3 is regulated reliably.

Figure 23:
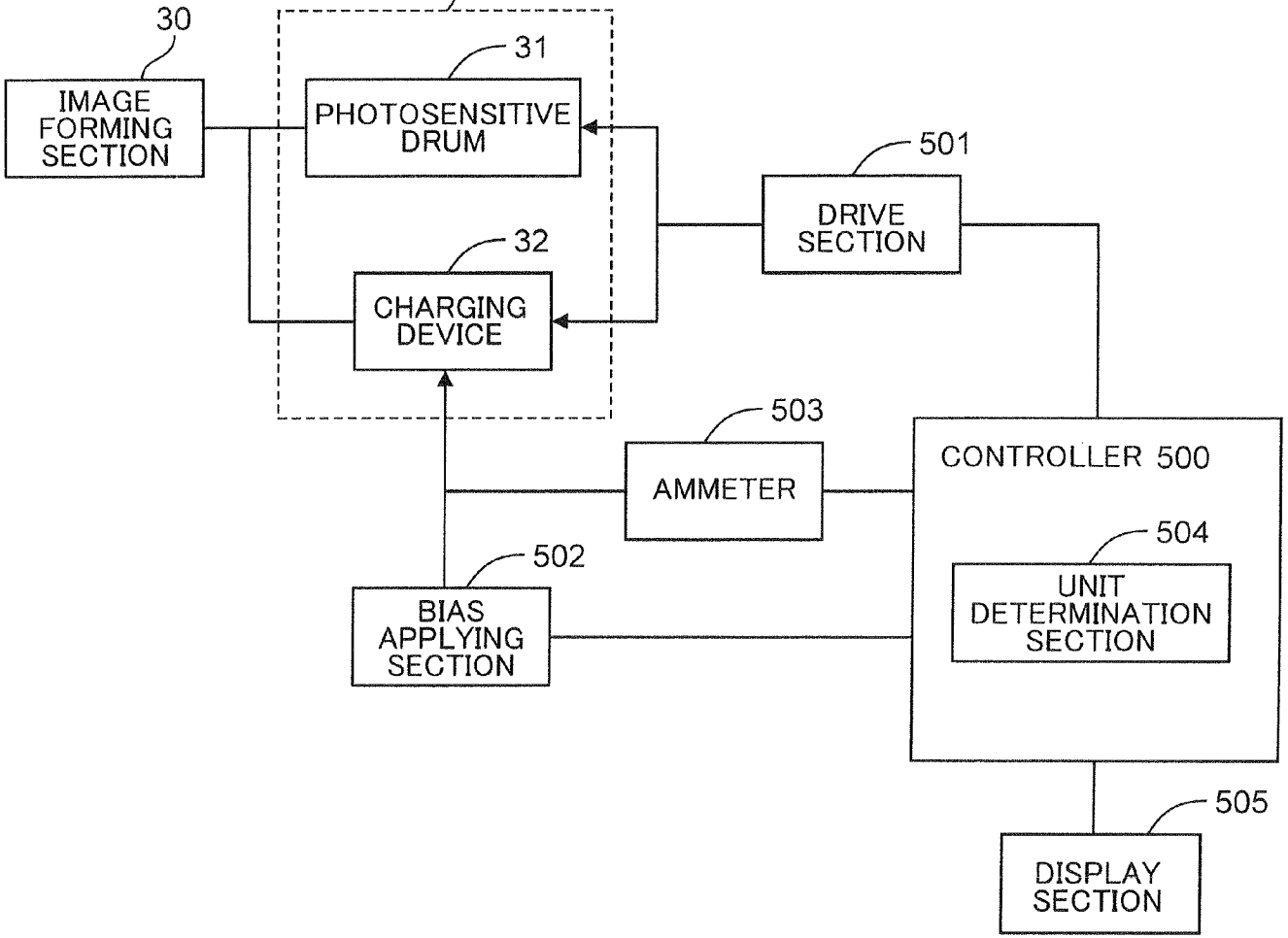
FIG. 23 is an electrical block diagram of the image forming apparatus according to the embodiment of the present disclosure.

Next, the present embodiment describes a determination section that determines whether the drum unit 350 is mounted or not. The image forming apparatus 1 has a controller 500 that controls overall operations of the sections provided in the image forming apparatus 1. FIG. 23 is a functional block diagram of the controller 500. The controller 500 is configured by a central processing unit (CPU), a read only memory (ROM) for storing control programs, a random access memory (RAM) used as a work area of the CPU, and the like. In addition to the image forming section 30 described above, a drive section 501, the bias applying section 502 (a first voltage applying section, a charged voltage applying section), an ammeter 503 (a current detector), a display section 505 (an error display section), and the like are electrically connected to the controller 500.

The drive section 501 has an motor to rotary drive the photosensitive drum 31 and the charging device 32. The bias applying section 502 is connected to the charging device 32 and applies a charging bias to the charging device 32 in order to charge the surface of the photosensitive drum 31 to a certain potential. The ammeter 503 is connected between the charging device 32 and the bias applying section 502 and detects the value of a current flowing to the charging device 32 (the value of a current flowing out of the bias applying section 502) in response to the application of the charging bias. The ammeter 503 is also used in an image forming operation in order to determine whether the value of a charging bias applied to the charging device 32 is reasonable or not. The display section 505, provided in an exterior portion of the main body housing 10, displays information about unmounting of the drum unit 350 in response to a determination result of a unit determination section 504 that is described hereinafter. It should be noted that the display section 505 may be a monitor of a known personal computer that transmits image data to the image forming apparatus 1.

The controller 500 functions to have the unit determination section 504 (a first detector, an image carrier unit detector) as the CPU executes the control programs stored in the ROM. When the current value detected by the ammeter 503 is smaller than a previously set threshold, the unit determination section 504 determines that the drum unit 350 is not mounted in the third position S3 (unmounted).

In a case in which the state of the rear cover 12 (FIG. 2) of the main body housing 10 is changed from the open state to the closed state while a main power of the image forming apparatus 1 is on (power is applied) and thereby a voltage is supplied to the image forming section 30, or in a case in which the state of the main power of the image forming apparatus 1 is changed from an OFF state to an ON state, the controller 500 controls the drive section 501, and consequently the photosensitive drum 31 and the charging device 32 are driven to rotate preliminarily. The controller 500 also controls the bias applying section 502, and consequently a charging bias is applied to the charging device 32 preliminarily.

In so doing, in a case in which the drum unit 350 is mounted in the third position S3, the ammeter 503 detects a current value that is equal to or greater than the previously set threshold, based on an electrical resistance value of the charging device 32. On the other hand, in a case in which the drum unit 350 is not mounted in the third position S3, the ammeter 503 detects a current value that is equal to or less than the threshold. Then, electrical signals based on the current values are output to the controller 500. When the current value detected by the ammeter 503 is smaller than the previously set threshold, the unit determination section 504 determines that the drum unit 350 is not mounted in the third position S3. The unit determination section 504 then causes the display section 505 to display the information about unmounting of the drum unit 350.

Figure 24:
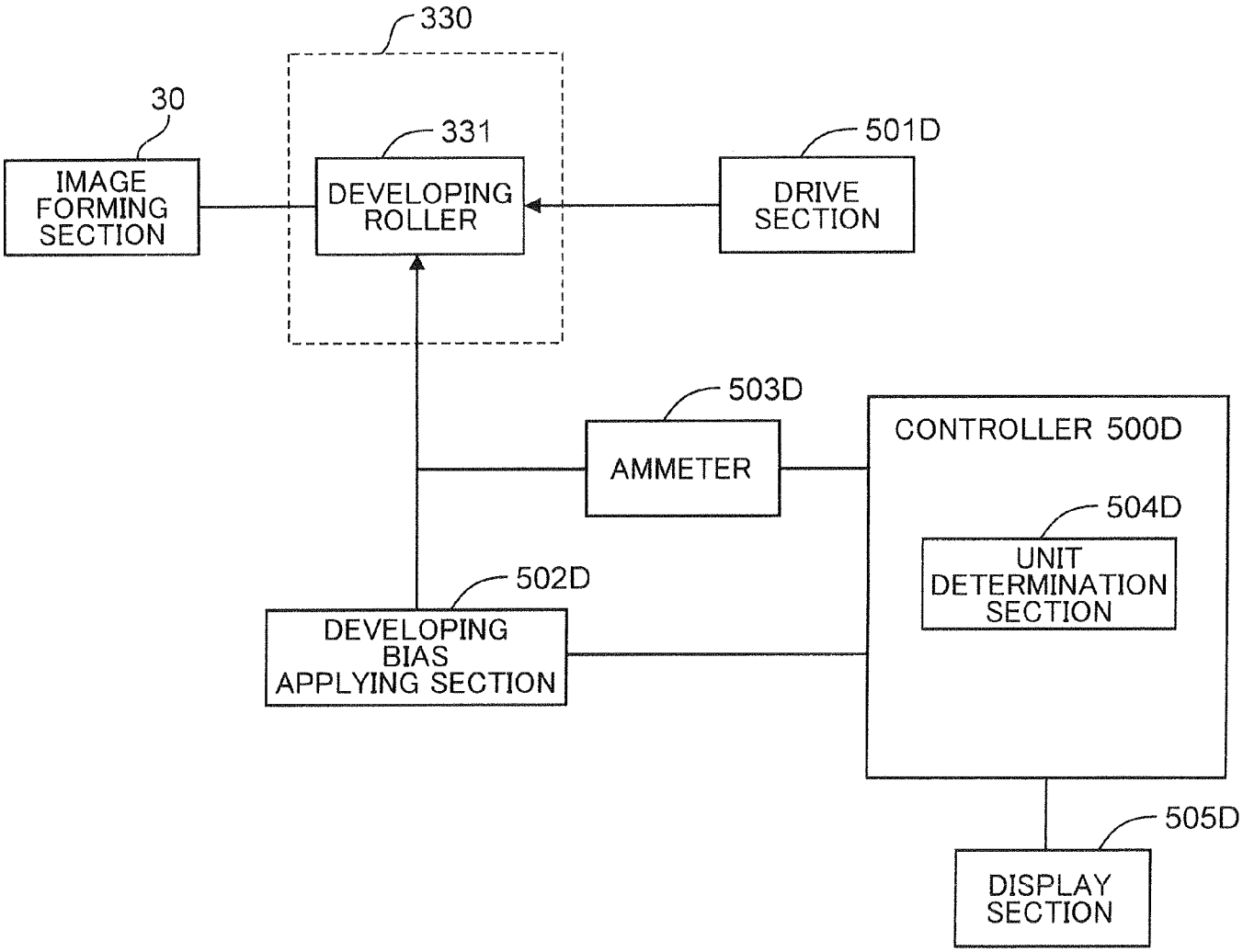
FIG. 24 is an electrical block diagram of an image forming apparatus according to another embodiment of the present disclosure.

The present embodiment, as described above, can detect whether or not the drum unit 350 is mounted in a section behind the internal space S that is further back of the waste toner bottle 600, i.e., a section that is closer to the rear cover 12. In order to detect whether the drum unit 350 is mounted or not, the bias applying section 502 and the ammeter 503 that are originally installed in the image forming apparatus 1 in order to execute image formation are used, instead of providing a special detector. Therefore, cost reduction of the image forming apparatus 1 can be realized. Similarly to detecting whether the drum unit 350 is mounted or not, whether the developing unit 330 is mounted or not can be detected with the similar configuration. FIG. 24 is a functional block diagram of a controller 500D used when detecting whether the developing unit 330 is mounted or not. In case of detecting whether the developing unit 330 is mounted or not, it is preferred that a developing bias applying section 502D provided in the image forming apparatus 1 and an ammeter 503D provided between the developing bias applying section 502D and the developing roller 331 be used in order to apply a developing bias to the developing roller 331.

The above has described the image forming apparatus 1 according to the embodiment of the present disclosure; however, the present disclosure is not limited thereto. Thus, for example, the following modifications can be applied.

(1) In the embodiment described above, the waste toner bottle 600 is described as a unit mounted in the first position S1 and the developing unit 330 and the drum unit 350 are described as units mounted in the second position S2 and the third position S3 respectively. However, the present disclosure is not limited to the embodiment. In addition to the developing unit 330 and the drum unit 350, a transfer unit 34H with the transfer roller 34 and the like may be the units mounted in the second position S2 and the third position S3. Furthermore, the developing unit 330 may be mounted in the first position S1 and the drum unit 350 in the second position S2.

Figure 25:
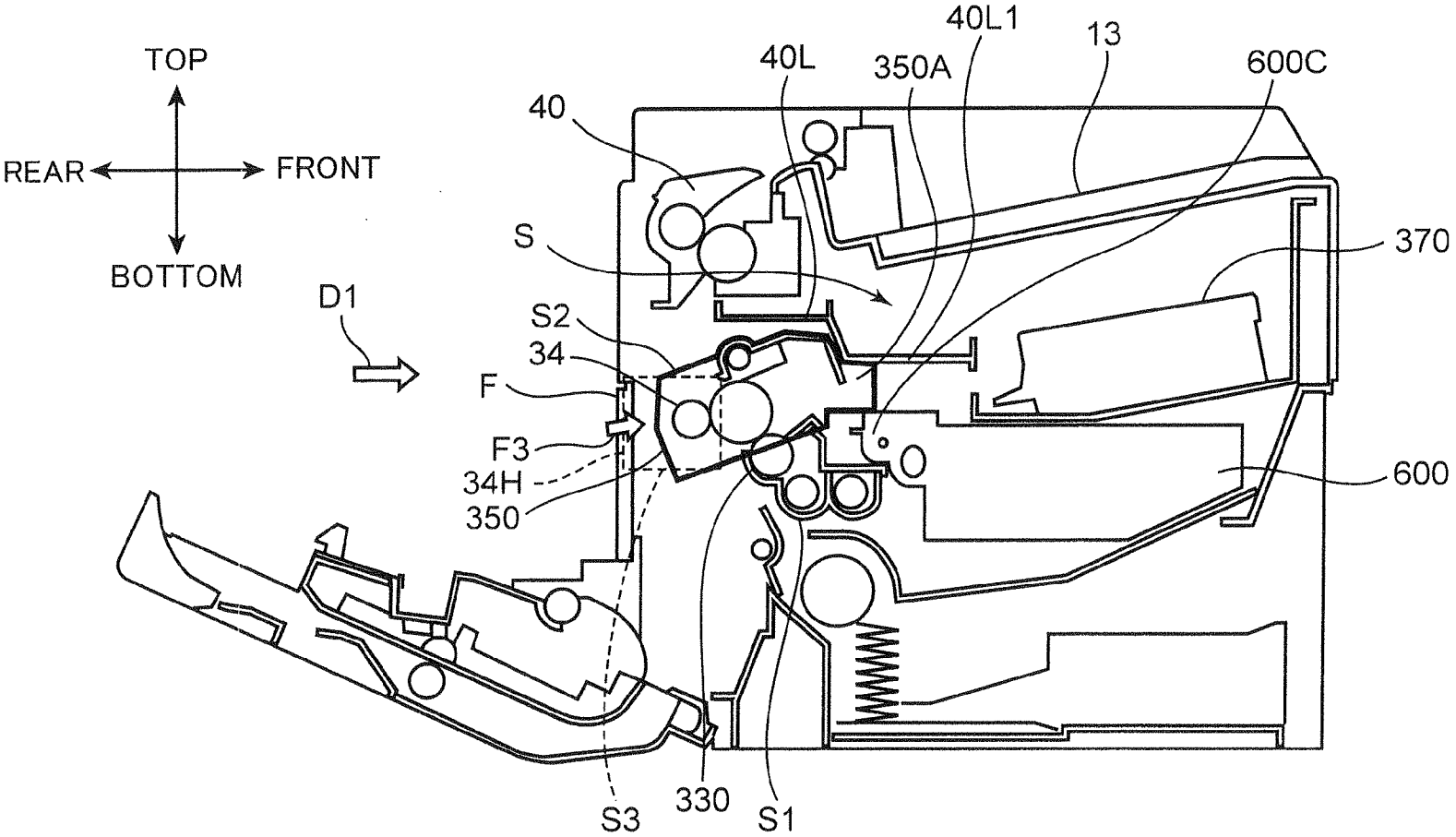
FIG. 25 is a side sectional diagram showing a state in which a waste toner bottle, a developing device, a drum unit, and a transfer unit are mounted in the image forming apparatus according to the other embodiment of the present disclosure.

FIG. 25 is a side sectional diagram of the image forming apparatus 1, showing a state in which the developing unit 330, the drum unit 350, and the transfer unit 34H are mounted in the main body housing 10. In this embodiment, after the developing unit 330 is mounted in the first position S1 and the drum unit 350 in the second position S2, the transfer unit 34H is mounted in the third position S3. In the present embodiment, the transfer roller 34 is rotatably supported, not by the reversing unit 25 but by the transfer unit 34H. The transfer unit 34H is mounted in the third position S3, in a state in which the rear cover 12 and the reversing unit 25 are opened. In so doing, similarly to the previous embodiment, the transfer unit 34H can be mounted in the third position S3 only when the drum unit 350 is mounted in the second position S2, so that an unmounted state of the drum unit 350 can be avoided. Moreover, an unmounted state of the transfer unit 34H can be avoided by allowing an ammeter, not shown, to detect a transfer current that flows from a transfer bias applying section, not shown, into the transfer roller 34 mounted in the third position S3. An unmounted state of the developing unit 330 maybe avoided by mounting the transfer unit 34H in the third position S3 only when the developing unit 330 is mounted in the first position S1. In this case as well, the unmounted state of the transfer unit 34H can be avoided by allowing the ammeter, not shown, to detect a transfer current that flows from the transfer bias applying section, not shown, into the transfer roller 34 mounted in the third position S3.

(2) In the embodiment described above, the developing unit 330 and the drum unit 350 can be mounted in the second position S2 and the third position S3 respectively when the waste toner bottle 600 is mounted in the first position S1. However, the present disclosure is not limited thereto. For instance, the developing unit 330 may be mounted in the second position S2 when the waste toner bottle 600 is mounted in the first position S1, and the drum unit 350 may be mounted from a fourth insertion path F4 shown in FIG. 7 into a fourth position S4 when the developing unit 330 is mounted in the second position S2. In this case, in the previous embodiment, the right-side end section 601A of the top panel 601 of the waste toner bottle 600 mounted in the first position S1 presses only the first pressed piece 701 of the development regulating member 70 rightward and causes the development regulator 702 to retract from the first groove section 90. Further, a wall section (not shown) of the developing unit 330 mounted in the second position S2 or a projection (not shown) of this wall section presses the second pressed piece 801 of the drum regulating member 80 rightward. As a result, the drum regulator 802 retracts from the second groove section 91 in response to the fact that the developing unit 330 is mounted in the second position S2. Then, the drum unit 350 can be mounted in the fourth position S4 described above. Therefore, the state of the drum regulator 802 can be changed between a state in which the drum regulator 802 projects to the fourth insertion path F4 when the developing unit 330 is not mounted in the second position S2 (a fifth state) and a state in which the drum regulator 802 retracts from the fourth insertion path F4 when the developing unit 330 is mounted in the second position S2 (a sixth state). In this case, the bias applying section 502 described above functions as a second voltage applying section and the unit determination section 504 as a second detector. In other words, when the current value detected by the ammeter 503 is smaller than a previously set threshold, the unit determination section 504 determines that the drum unit 350 is not mounted in the fourth position F4.

(3) In the embodiment described above, the projecting piece 701B of the development regulating member 70 is provided so as to be able to come into abutment with the right side surface of the second pressed piece 801, and the second pressed piece 801 and the drum regulator 802 are caused to project leftward by the biasing force of the helical torsion coil spring 707. The configurations of the development regulating member 70 and the drum regulating member 80 are not limited thereto. The development regulating member 70 and the drum regulating member 80 may be biased separately towards the inside (left-hand side) of the internal space S. In such a case, a helical torsion coil spring, not shown, may be wound around the rotating shaft 804 of the drum regulating member 80, and the second pressed piece 801 and the drum regulator 802 of the drum regulating member 80 may be caused to project to the third insertion path F3 of the drum unit 350 by this helical torsion coil spring.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image forming section that executes an image forming operation;

a casing that has a plurality of surfaces and an internal space in which the image forming section is disposed;

a wall section that is openable/closeable with respect to the casing, the wall section defining one surface of the casing when the wall section is in a closed state and exposing an opening portion that opens the internal space to the outside of the casing when the wall section is in an open state;

a first unit that is mounted through the opening portion and into a first position of the internal space when the wall section is in the open state;

a first insertion path through which the first unit passes in the internal space when the first unit is mounted in the first position;

a second unit that is mounted through the opening portion and into a second position of the internal space between the wall section and the first position in the direction intersecting with the wall section when the wall section enters the open state;

a second insertion path through which the second unit passes in the internal space when the second unit is mounted in the second position; and a first regulating member that is capable of changing a state thereof between a first state in which the first regulating member projects into the second insertion path and interferes with the second unit when the first unit is not mounted in the first position, and a second state in which the first regulating member retracts from the second insertion path when the first unit is mounted in the first position, wherein the internal space is disposed between a first inner wall section of the first side wall and a second inner wall section of a second side wall opposite to the first side wall, the first side wall and the second side wall each intersecting with the wall section of the housing and defining surfaces of the casing, the first unit and the second unit are provided to extend in a direction along the wall section of the housing in the internal space and are mounted into the internal space in a direction intersecting the wall section, and the first regulating member in the first state projects from the first inner wall section of the first side wall toward the second inner wall section in the internal space so that the first regulating member interferes with the second unit being mounted into the internal space in the direction intersecting the wall section.

2. The image forming apparatus according to claim 1, further comprising:

an interlocking section that causes the first regulating member to retract from the second insertion path, in conjunction with mounting of the first unit in the first position.

3. The image forming apparatus according to claim 2, wherein the interlocking section includes:

a first pressed section that projects to the first insertion path in the first state and retracts from the first insertion path by being pressed by the first unit in the second state;

a biasing section that biases the first pressed section toward the first insertion path; and a coupling piece that connects the first regulating member and the first pressed section.

4. The image forming apparatus according to claim 1, further comprising:

a third unit that is mounted through the opening portion and into a third position of the internal space closer to the wall section than the first position is, when the wall section enters the open state;

a third insertion path through which the third unit passes in the internal space when the third unit is mounted in the third position; and a second regulating member that is capable of changing a state thereof between a third state in which the second regulating member projects to the third insertion path when the first unit is not mounted in the first position, and a fourth state in which the second regulating member retracts from the third insertion path when the first unit is mounted in the first position.

5. The image forming apparatus according to claim 4, wherein the second unit or the third unit is a unit to which a voltage is applied in response to the image forming operation, the image forming apparatus further comprising:

a first voltage applying section that applies a first voltage to the second unit or the third unit, when power is applied to the image forming section or as the state of the wall section changes from the open state to the closed state; and a first detector that detects that the second unit or the third unit is not yet mounted, when a value of a current that flows out of the first voltage applying section as a result of the application of the first voltage is equal to or less than a previously set threshold.

6. The image forming apparatus according to claim 5, wherein the unit to which the voltage is applied is an image carrier unit having an image carrier, a developing unit that forms an image of colorant onto the image carrier, or a transfer unit that transfers the image of colorant from the image carrier.

7. The image forming apparatus according to claim 4, wherein the first unit is a waste colorant bottle for housing colorant used in the image forming section, the second unit is a developing unit that forms an image of colorant on an image carrier, and the third unit is an image carrier unit having the image carrier.

8. The image forming apparatus according to claim 1, further comprising:

a fourth unit that is mounted through the opening portion and into a fourth position of the internal space closer to the wall section than the second position is, when the wall section enters the open state;

a fourth insertion path through which the fourth unit passes in the internal space when the fourth unit is mounted in the fourth position; and a third regulating member that is capable of changing a state thereof between a fifth state in which the third regulating member projects to the fourth insertion path when the second unit is not mounted in the second position, and a sixth state in which the third regulating member retracts from the fourth insertion path when the second unit is mounted in the second position.

9. The image forming apparatus according to claim 8, wherein the fourth unit is a unit to which a voltage is applied in response to the image forming operation, the image forming apparatus further comprising:

a second voltage applying section that applies a second voltage to the fourth unit, when power is applied to the image forming section or as the state of the wall section changes from the open state to the closed state; and a second detector that detects that the fourth unit is not yet mounted, when a value of a current that flows out of the second voltage applying section as a result of the application of the second voltage is equal to or less than a previously set threshold.

10. The image forming apparatus according to claim 8, wherein the fourth unit is an image carrier unit having an image carrier, a developing unit that forms an image of colorant onto the image carrier, or a transfer unit that transfers the image of colorant from the image carrier.

11. The image forming apparatus according to claim 8, wherein the first unit is a waste colorant bottle for housing colorant used in the image forming section, the second unit is a developing unit that forms an image of colorant on an image carrier, and the fourth unit is an image carrier unit having the image carrier.

12. The image forming apparatus according to claim 1, wherein the first unit is a developing unit that forms an image of colorant on an image carrier, and the second unit is an image carrier unit having the image carrier, the image forming apparatus further comprising:

a charger that is provided in the second unit and charges a surface of the image carrier;

a charged voltage applying section that applies a charged voltage to the charger;

a current detector that detects a current value of a current flowing out of the charged voltage applying section; and an image carrier unit detector that detects that the image carrier unit is not yet mounted, when the current value detected by the current detector is equal to or less than a previously set threshold.

13. The image forming apparatus according to claim 12, further comprising:

an error display section that displays an error when the image carrier unit detector detects that the image carrier is not yet mounted.

14. The image forming apparatus according to claim 1, further comprising:

a guide section that guides the first unit to the first position along the first insertion path, wherein the guide part guides the first unit in a direction intersecting with the wall section and guides the first unit toward the side wall at a part immediately before the first position.

15. The image forming apparatus according to claim 1, wherein the image forming section executes the image forming operation with a colorant, and the first unit is a waste colorant bottle for housing the colorant used in the image forming section.

* * * * *